US007263193B2

(12) United States Patent
Abel

(10) Patent No.: US 7,263,193 B2
(45) Date of Patent: Aug. 28, 2007

(54) CROSSTALK CANCELER

(76) Inventor: Jonathan S. Abel, 184 Tennyson Ave., Palo Alto, CA (US) 94301

( * ) Notice: Subject to any disclaimer, the term of this patent is extended or adjusted under 35 U.S.C. 154(b) by 506 days.

(21) Appl. No.: 10/691,211

(22) Filed: Oct. 21, 2003

(65) Prior Publication Data

US 2004/0179693 A1 Sep. 16, 2004

Related U.S. Application Data

(62) Division of application No. 09/195,745, filed on Nov. 18, 1998, now Pat. No. 6,668,061.

(60) Provisional application No. 60/069,015, filed on Dec. 10, 1997, provisional application No. 60/065,637, filed on Nov. 18, 1997.

(51) Int. Cl.
*H04R 5/00* (2006.01)

(52) U.S. Cl. ..... 381/1; 381/17

(58) Field of Classification Search ..... 381/19, 381/18

See application file for complete search history.

(56) References Cited

U.S. PATENT DOCUMENTS

| | | | |
|---|---|---|---|
| 3,236,949 | A | 2/1966 | Atal et al. |
| 4,893,342 | A | 1/1990 | Cooper et al. |
| 4,910,779 | A | 3/1990 | Cooper et al. |
| 4,975,954 | A | 12/1990 | Cooper et al. |
| 5,889,867 | A | 3/1999 | Bauck |
| 6,009,178 | A | 12/1999 | Abel et al. |
| 6,243,476 | B1 | 6/2001 | Gardner |
| 6,307,941 | B1 | 10/2001 | Tanner, Jr. et al. |
| 6,442,277 | B1 | 8/2002 | Lueck et al. |

*Primary Examiner*—Xu Mei
(74) *Attorney, Agent, or Firm*—Carr & Ferrell LLP

(57) ABSTRACT

The invention is a crosstalk canceler wherein different frequency bands are canceled at different locations so as to allow greater listener movement about the "sweet spot" while maintaining effective crosstalk cancellation. A spectrally smooth canceler equalization is used, reducing artifacts for listeners away from the sweet spot and further enlarging the sweet spot. Finally, the canceler equalization is adapted to either the anticipated or the actual crosscoherence among the input channels, producing a natural equalization regardless of the input.

2 Claims, 33 Drawing Sheets

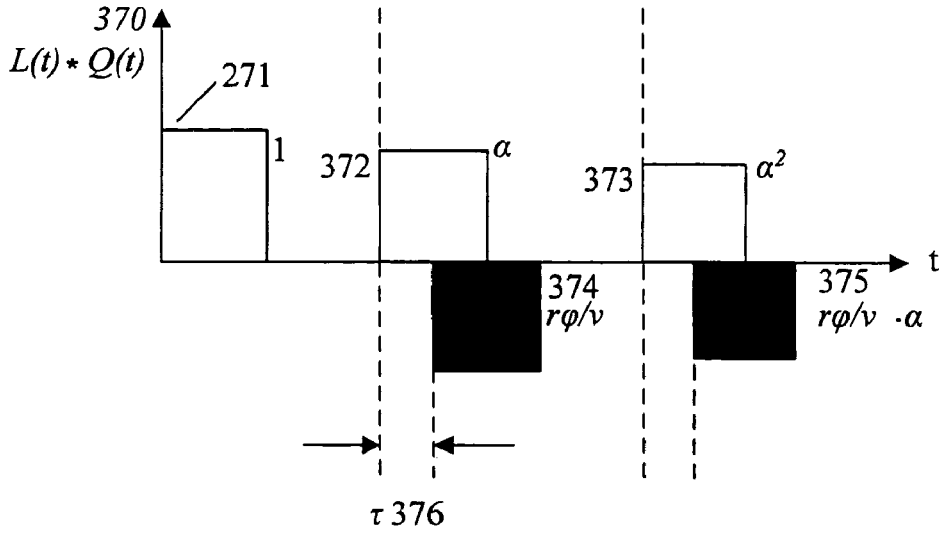
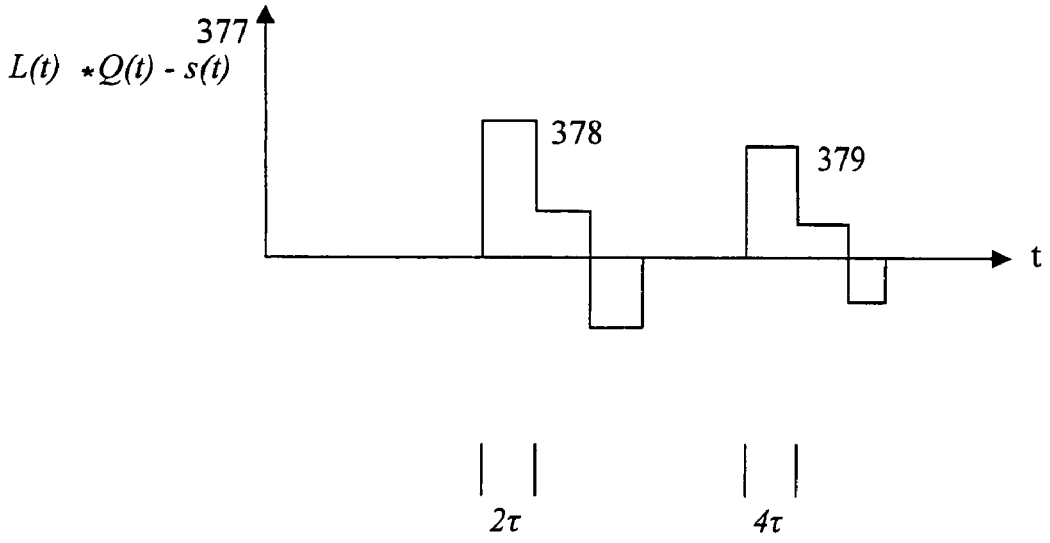
FIG. 12

CROSSTALK CANCELER

CROSS REFERENCE TO RELATED APPLICATION

This application is a divisional application and claims the priority benefit of U.S. patent application Ser. No. 09/195,745, entitled "Crosstalk Canceler," filed Nov. 18, 1998, now U.S. Pat. No. 6,668,061 which claims benefit of U.S. Provisional Application No. 60/065,637 filed Nov. 18, 1997 and U.S. Provisional Patent Application No. 60/069,015 filed Dec. 10, 1997. The foregoing applications are incorporated by reference.

BACKGROUND OF THE INVENTION

This invention pertains to audio signal processing, and specifically to a system and method for crosstalk cancellation.

There are a number of settings in which separate audio signals are prepared for the left and right ears of a listener. Such signals are referred to as binaural signals, and are distinct from stereo signals in that the left and right binaural channels are intended to be heard only by the respective left and right ears of the listener.

Binaural signals are typically used to convey spatial information about the sounds presented. It turns out that a sense of sound source location is created by subtle features imposed on the signals arriving at the left and right ears of the listener [5, 6, 7]. By separately processing left-ear and right-ear signals, as illustrated in FIG. 1, a sound source can be made to appear at any desired location in a listener's perceptual space.

Such synthetic spatial audio—commonly referred to as 3D audio—has application to video games, teleconferencing, and virtual environments, wherein each sound may be processed so as to appear to originate from its generating object. Another 3D audio application is placing "virtual" speakers about a listener, for instance in a standard home theater surround sound configuration as shown in FIG. 2. Here, each of five surround signals 30, 40, 50, 60, 70 is processed according to its location 34, 44, 54, 64, 74 to form left-ear and right-ear signals 32, 42, 52, 62, 72 and 33, 43, 53, 63, 73, which are summed to form the left-ear and right-ear channels 35 and 36 of a binaural signal. Presenting the binaural signal to a listener over headphones gives the impression of a five-speaker surround system, though only the two binaural channels are used.

In all of these applications, headphones or similar transducers are often used to ensure that the left and right binaural channels are delivered, respectively, to the left and right ears of the listener [5, pp. 217-220]. If the binaural signal were played through stereo speakers configured as shown in FIG. 4, each listener ear would hear both binaural channels. This mixing of the left and right binaural channels, called crosstalk, can significantly degrade the spatial cues in the binaural signal, diminishing the listening experience.

There are, however, situations such as in the case of an arcade game where the use of headphones or earphones is impractical, and it is desired to use stereo speakers to present binaural material. In [1], Atal and Schroeder presented a system called a crosstalk canceler for processing a binaural signal to develop a pair of speaker signals that would deliver the original binaural signal to a properly positioned listener.

The system relies on differences among the transfer functions between the two speakers and the two ears. The basic idea is to cancel the crosstalk appearing in the right ear from the left speaker by sending a negative filtered version of the left speaker signal out the right speaker. The filtering is such that the crosstalk from the left speaker and the canceling signal from the right speaker arrive at the right ear simultaneously as negative replicas of each other, and sum to zero. Left ear crosstalk from the right speaker is similarly eliminated.

The crosstalk canceler proposed in [1] can be very effective, but has several drawbacks which limit its usefulness. First, so that the cancellation signal exactly cancels the crosstalk signal, the listener must be carefully positioned at the so-called sweet spot. In addition, the transition between effective cancellation in the sweet spot and no cancellation out of the sweet spot is very abrupt, making it difficult for listeners to find the sweet spot. Consider a 5 kHz signal having a wavelength of about two inches. The listener only need move his head an inch closer to one speaker than the other to turn the perfect cancellation between the crosstalk and canceling signals into perfect reinforcement between the two.

In addition to restricting listener movement, the canceler [1] is sensitive to the shape of the listener's head and ears. To get effective cancellation, particularly at high frequencies, the canceling signal filter should be tailored to the listener.

The second drawback has to do with the timbre or equalization of the canceled signal as compared to that of the original binaural signal. Listeners in the sweet spot sometimes sense that the canceler output is lacking in low-frequency energy compared to the original binaural signal. Listeners away from the sweet spot complain of phase artifacts and a position sensitive equalization. (Note that the apparent equalization away from the sweet spot is important in some applications. For example, consider a television equipped with stereo speakers and virtual surround sound processing as shown in FIG. 3. While the crosstalk canceler can deliver the virtual surround binaural signal to listener 80 in the sweet spot, the crosstalk canceler should not compromise the listening experience of those away from the sweet spot.)

To address the restrictions on listener movement, Cooper and Bauck in [2] proposed a crosstalk canceler which cancels only the low frequencies; the high-frequency portion of the binaural input is sent to the output unchanged. Many audio signals have their energy concentrated below a few kilohertz, so that canceling only those frequencies should not significantly diminish the cancellation effect. Because the wavelengths for the canceled portion of the binaural signal are relatively large, the listener has greater freedom of movement before perceiving a change in cancellation effectiveness. Essentially, the canceler trades a less effective cancellation in the sweet spot for a broader sweet spot.

In [3, 4], Cooper and Bauck present a canceler equalization based on the observation that each canceler has a set of so-called "null canceler" frequencies at which the canceling signal filter is orthogonal to—that is, ±90° out of phase from—the direct signal filter. The proposed equalization inverts the sum of the power in the direct and canceling filters at the null canceler frequencies. This equalization is an improvement over the one implied in [1] in that listeners away from the sweet spot hear few artifacts, and those in the sweet spot experience less of a timber change. However, for certain kinds of source material, a timbre change is still noticeable for listeners in and out of the sweet spot.

Therefore it is an object of the present invention to provide a crosstalk canceler allowing greater listener movement while maintaining effective cancellation, and having an equalization which leaves the input binaural signal uncolored. Another object is to develop a canceler which is insensitive to listener head and ear acoustic properties. It is also an object of the present invention to broaden the transition between effective cancellation in the sweet spot and no cancellation outside the sweet spot to help listeners find the sweet spot. Another object of the present invention is to develop a canceler which is relatively free of artifacts away from the sweet spot. Finally, it is an object of the present invention to adapt the equalization to the input signal so as to minimize timbre changes imposed by the canceler.

SUMMARY OF THE INVENTION

To provide greater listener freedom of movement, the basic idea is to cancel different frequency bands at different locations, rather than to cancel all frequency bands at the same location as is currently practiced. In this way, changes in listener position do not eliminate cancellation, but shift the part of the signal canceled. In addition, this widening of the sweet spot creates a smooth transition between regions of effective cancellation and no cancellation.

The expectation in canceling different frequency bands at different locations is that while the set of listener positions where some cancellation occurs is broader, the cancellation is everywhere less effective than at the sweet spot of a traditional canceler. That the sweet spot of the new canceler is larger than that of traditional cancelers was verified in listening tests using virtual surround sound, speaker spreader, and one-channel signals as the binaural input. Surprisingly, the inventive canceler was perceived to have nearly as effective cancellation in the sweet spot as the traditional canceler.

In analyzing the signal arriving at a listener's ears from a traditional canceler, it was discovered that unless the listener is precisely positioned, the signal arrives with a timbre change compared to the original binaural signal, irrespective of the cancellation effectiveness. A similar timbre change appears when the acoustic characteristics of the listener's head and ears are not those used in designing the crosstalk canceler, regardless of listener position.

The inventive canceler has an equalization which takes into account the signal arriving at the ears of a variety of listeners positioned in a range of locations. The inventive equalization is the one minimizing the timbre change over an expected range of listener positions and listener acoustic characteristics. Whereas the power spectrum of the traditional crosstalk canceler equalization has a number of peaks and valleys, that of the inventive equalization is by comparison smooth.

The timbre of output from cancelers using the inventive equalization, in fact, is less sensitive to listener position or acoustic properties than is that from the traditional canceler [1]. In addition, the inventive equalization has the unexpected benefit or reducing artifacts for listeners outside the sweet spot.

Finally, it was noted that binaural signals having a large monophonic component seemed to require an equalization with more bass emphasis than did binaural signals with a small monophonic component. Based on this observation, a canceler equalization was developed which depends on the percentage of monophonic signal energy in the input binaural signal. In this way, the canceler equalization may be adapted to the binaural input.

One embodiment of the invention is a crosstalk canceler providing greater listener freedom of movement comprising an input audio signal, two output channels, and a network of filters designed to eliminate crosstalk at the ear of a listener at different listener positions for different frequency bands of the input audio signal.

Another embodiment of the invention is a crosstalk canceler equalization which is less sensitive to listener acoustic characteristics and listener position, said equalization being a spectrally smooth version of an input equalization, the details of which may be optionally determined by anticipated ranges of listener acoustic characteristics and listener positions.

An additional embodiment of the invention is a crosstalk canceler having an equalization designed to leave unchanged at the output the power spectrum of a Gaussian binaural input with a specified crosscoherence. Another aspect of this embodiment is a canceler in which the crosscoherence of the input binaural signal is sensed and used to adapt the characteristics of the canceler.

BRIEF DESCRIPTION OF THE DRAWINGS

FIG. 12 shows a crosstalk equalization error example.

DETAILED DESCRIPTION OF THE PREFERRED EMBODIMENT

Figure 4:
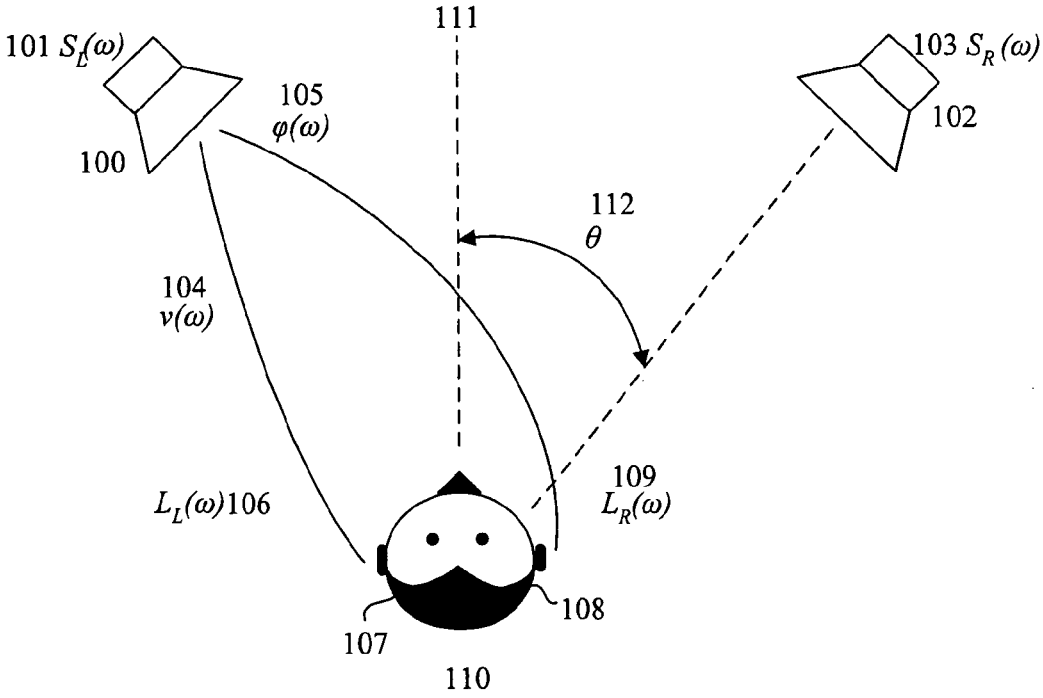
FIG. 4 shows the crosstalk geometry.

For clarity, the invention will be described with respect to the symmetric two-speaker, one-listener crosstalk scenario of FIG. 4. Modifications needed to apply the invention to asymmetric crosstalk geometries, to multiple listeners, or to more than two speakers will be readily apparent to those skilled in the art. In the following, references to listener position or ear position refer also to listener orientation as well as other geometric factors including speaker position and orientation. In addition, in the following equivalent time-domain and frequency-domain quantities and operations are used interchangeably; any technique discussed or description given in one domain is meant to apply in the other. Finally, the functions "mean" and "average" are to be understood in their general sense, for instance being weighted or unweighted arithmetic, geometric, or trimmed means and the like.

Crosstalk Cancellation

To better appreciate aspects of the present invention, the traditional crosstalk canceler will be described in detail. Referring to FIG. 4, consider two speakers 100 and 102 symmetrically placed about listener 110 at an angle θ 112 with respect to listener axis 111. Signals applied to the speakers will arrive at the listener's ears transformed according to near-ear and far-ear transfer functions ν(ω) 104 and ϕ(ω) 105 embodying, among other effects, the speaker radiation, speaker-listener propagation effects, and acoustic characteristics of the listener. Denoting by $s_l(t)$ and $s_r(t)$ the left and right speaker signals 101 and 103, the signals $l_l(t)$ 106 and $l_r(t)$ 109 appearing at the listener's left and right ears 107 and 108 are given by $$l_l(t)=\nu(t)*s_l(t)+\phi(t)*s_r(t), \tag{1}$$

$$l_r(t)=\phi(t)*s_l(t)+\nu(t)*s_r(t), \tag{2}$$

where * represents convolution, and ν(t) and ϕ(t) are the near-ear and far-ear impulse responses, that is, the inverse Fourier transforms of the near-ear and far-ear transfer functions ν(ω) and ϕ(ω). Expressed in the frequency domain, the listener ear sound pressure signals are $$l(\omega)=C(\omega)s(\omega), \tag{3}$$

where l(ω)and s(ω) are columns containing the listener ear signal and speaker signal Fourier transforms, $$l(\omega)=\begin{bmatrix} l_l(\omega) \\ l_r(\omega) \end{bmatrix},\ s(\omega)=\begin{bmatrix} s_l(\omega) \\ s_r(\omega) \end{bmatrix}, \tag{4}$$

and C(ω), the crosstalk matrix, contains the speaker-listener transfer functions, $$C(\omega)=\begin{bmatrix} \nu(\omega) & \phi(\omega) \\ \phi(\omega) & \nu(\omega) \end{bmatrix}. \tag{5}$$

It is clear that unless the far-ear transfer function ϕ(ω) is zero, a binaural signal applied directly to the speakers will exhibit crosstalk. However, as discussed above, crosstalk may be removed by processing the binaural signal so as to anticipate the changes imposed in propagating from the speakers to the listener.

Figure 5:
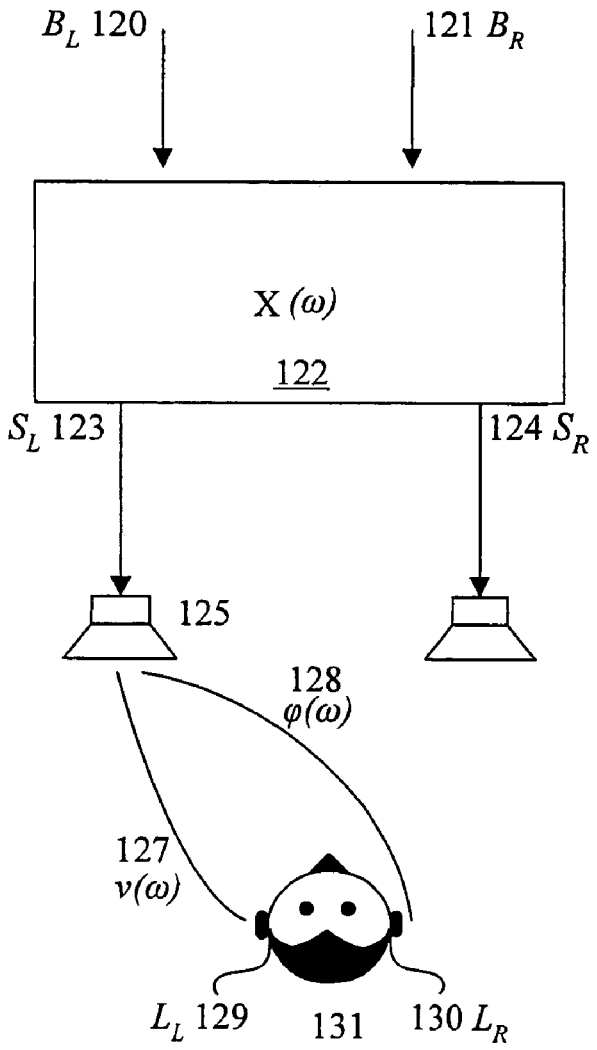
FIG. 5 shows a crosstalk canceler.

Consider the processing shown in FIG. 5. Binaural channels $b_l(\omega)$ 120 and $b_r(\omega)$ 121 are processed by canceler filter network 122 to produce crosstalk canceled speaker signals $s_l(\omega)$ 123 and $s_r(\omega)$ 124, which, in turn arrive at the ears of the listener transformed by the near-ear and far-ear transfer functions comprising the crosstalk matrix C(ω). The listener ear signals l(ω) are easily related to the binaural signal b(ω), $$l(\omega)=C(\omega)s(\omega)=C(\omega)X(\omega)b(\omega), \tag{6}$$

where b(ω) is the column of binaural channel signal transforms, $$b(\omega)=\begin{bmatrix} b_l(\omega) \\ b_r(\omega) \end{bmatrix}, \tag{7}$$

and where the matrix transfer function X(ω) is referred to as the canceler matrix. Note that if the inverse of the crosstalk C(ω) is realizable, setting the canceler to the crosstalk inverse, $$X(\omega)=C^{-1}(\omega), \tag{8}$$

will produce left and right listener ear signals $l_l(\omega)$ 129 and $l_r(\omega)$ 130 equal to the respective input left and right binaural channels $b_l(\omega)$ 120 and $b_r(\omega)$ 121.

Figure 6:
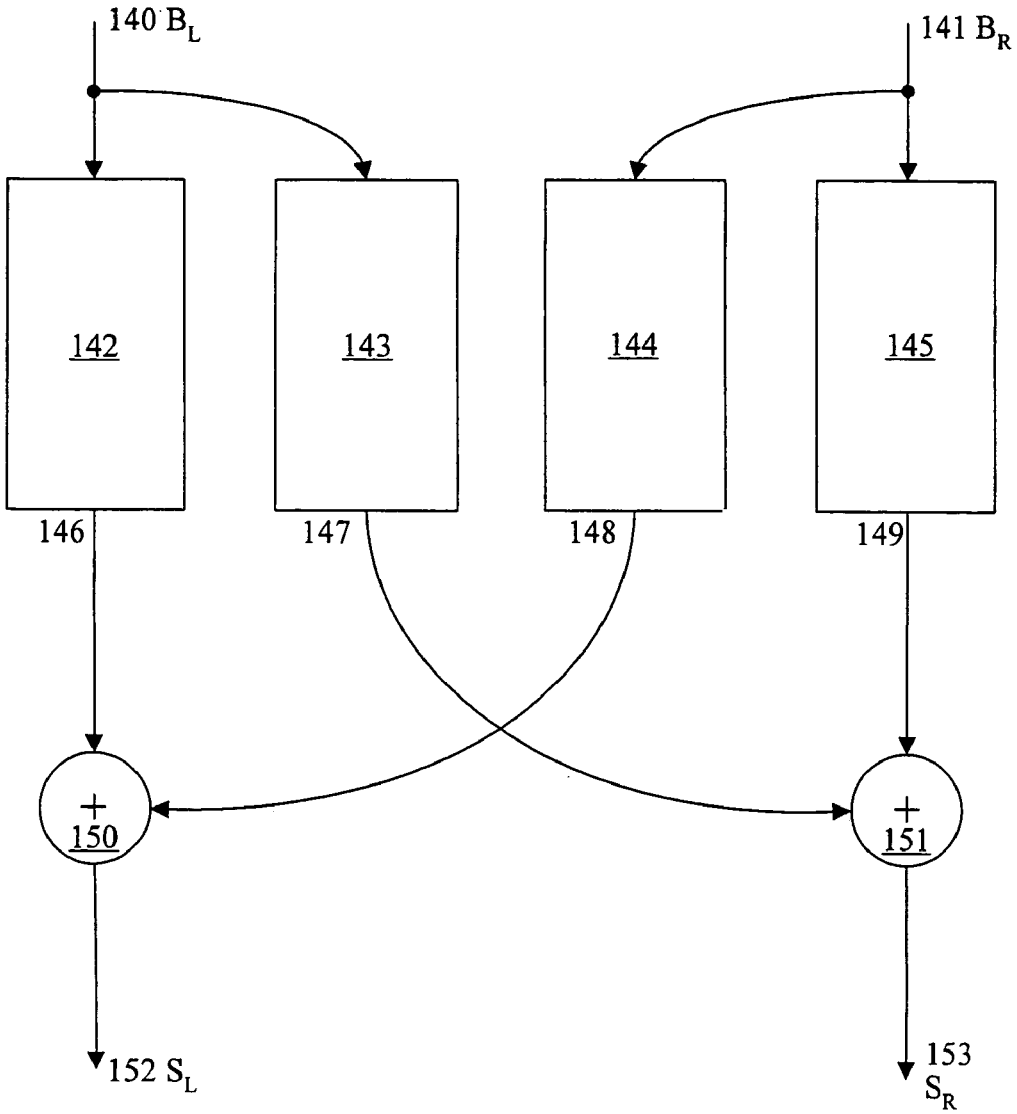
FIG. 6 shows a lattice crosstalk canceler.

The canceler inverse may be expressed in terms of the near-ear and fare transfer functions, $$X(\omega)=C^{-1}(\omega)=\frac{\begin{bmatrix} \nu(\omega) & -\phi(\omega) \\ -\phi(\omega) & \nu(\omega) \end{bmatrix}}{\nu^2(\omega)-\phi^2(\omega)}, \tag{9}$$

and implemented in the lattice architecture of FIG. 6. Here, binaural inputs 140 and 141 are applied to filters 142, 143, 144, and 145, each implementing the transfer function contained in the corresponding element of the canceler matrix (9). The filter outputs are combined to form canceled speaker outputs 152 and 153.

Note that for the crosstalk inverse to exist, the near-ear and far-ear transfer functions cannot be identical at any frequency. If this were the case, any canceling signal arriving at one ear would cancel the original signal in the other ear. Also, note that for X(ω) to be realizable, the quantity $\nu^2(\omega)-\phi^2(\omega)$ needs to be minimum phase. If this is not the case, then its minimum phase equivalent may be used to form its inverse in (9), and the signals appearing in the ear of the listener will be the binaural channel signals shifted in phase by the allpass component of $\nu^2(\omega)-\phi^2(\omega)$.

Figure 7:
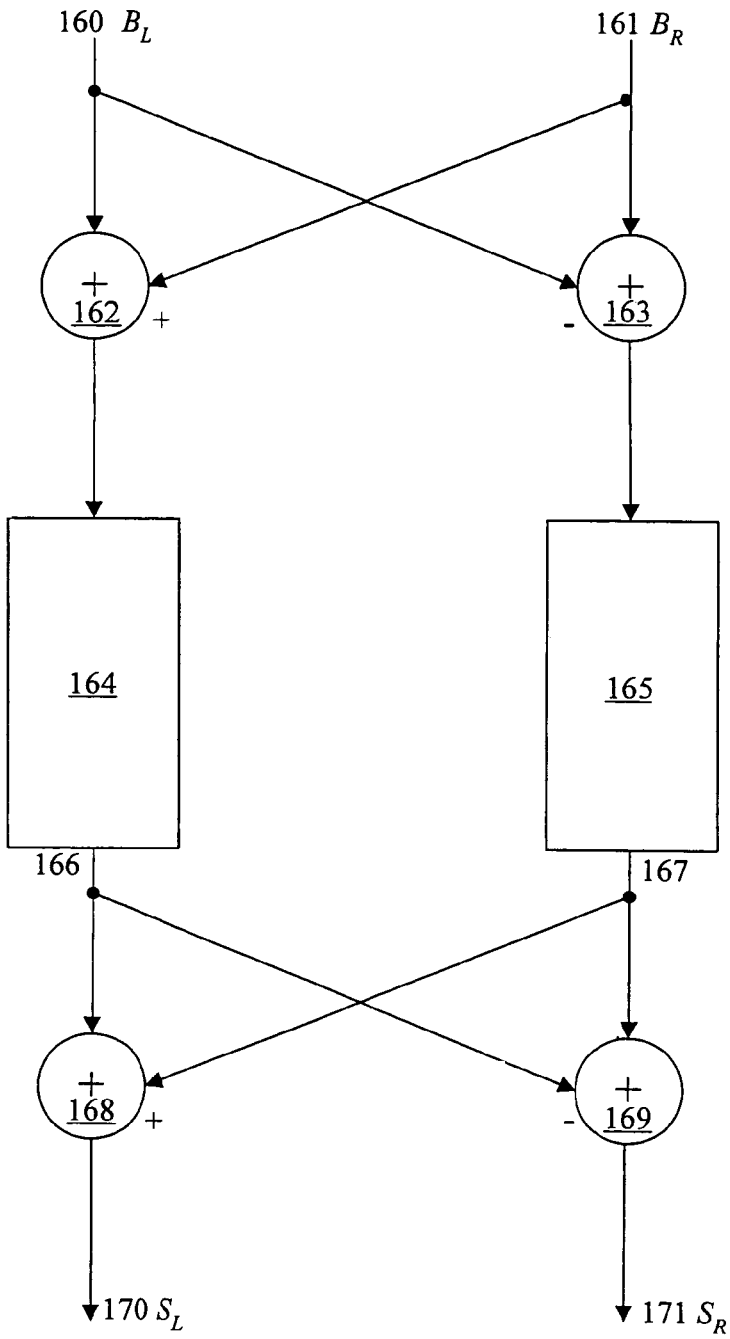
FIG. 7 shows a shuffler crosstalk canceler.

The canceler may also be formed by noting that the crosstalk matrix can be decomposed in terms of the sum and difference of the near-ear and far-ear transfer functions, $$C(\omega)=\frac{1}{2}\begin{bmatrix} 1 & 1 \\ 1 & -1 \end{bmatrix}\cdot\begin{bmatrix} \nu(\omega)+\phi(\omega) & 0 \\ 0 & \nu(\omega)-\phi(\omega) \end{bmatrix}\cdot\begin{bmatrix} 1 & 1 \\ 1 & -1 \end{bmatrix}, \tag{10}$$

where the diagonalizing matrix $$F = \begin{bmatrix} 1 & 1 \\ 1 & -1 \end{bmatrix} \tag{11}$$

is referred to as the shuffler matrix. Noting that the shuffler matrix F is twice its own inverse, the crosstalk canceler X(ω) can be written as $$X(\omega) = C^{-1}(\omega) = \frac{1}{2}\begin{bmatrix} 1 & 1 \\ 1 & -1 \end{bmatrix} \cdot \begin{bmatrix} \frac{1}{v(\omega)+\phi(\omega)} & 0 \\ 0 & \frac{1}{v(\omega)-\phi(\omega)} \end{bmatrix} \cdot \begin{bmatrix} 1 & 1 \\ 1 & -1 \end{bmatrix}, \tag{12}$$

leading to the shuffler canceler architecture shown in FIG. 7. In this canceler implementation, the sum and difference of binaural input channels 160 and 161 are filtered by shuffler sum filter 164 and shuffler difference filter 165, respectively, the outputs of which are summed and differenced to form the canceled speaker outputs 170 and 171. The advantage of this architecture is that only two filters are needed, rather than the four required by the lattice canceler shown in FIG. 6.

The crosstalk inverse may also be decomposed as follows, $$C^{-1}(\omega) = \begin{bmatrix} 1 & -\rho(\omega) \\ -\rho(\omega) & 1 \end{bmatrix} \cdot \frac{1}{v(\omega)} \cdot \frac{1}{1-\rho^2(\omega)}, \tag{13}$$

where ρ(ω) is the ratio of the far-ear transfer function to the near-ear transfer function, $$\rho(\omega)=\phi(\omega)/v(\omega). \tag{14}$$

Figure 8:
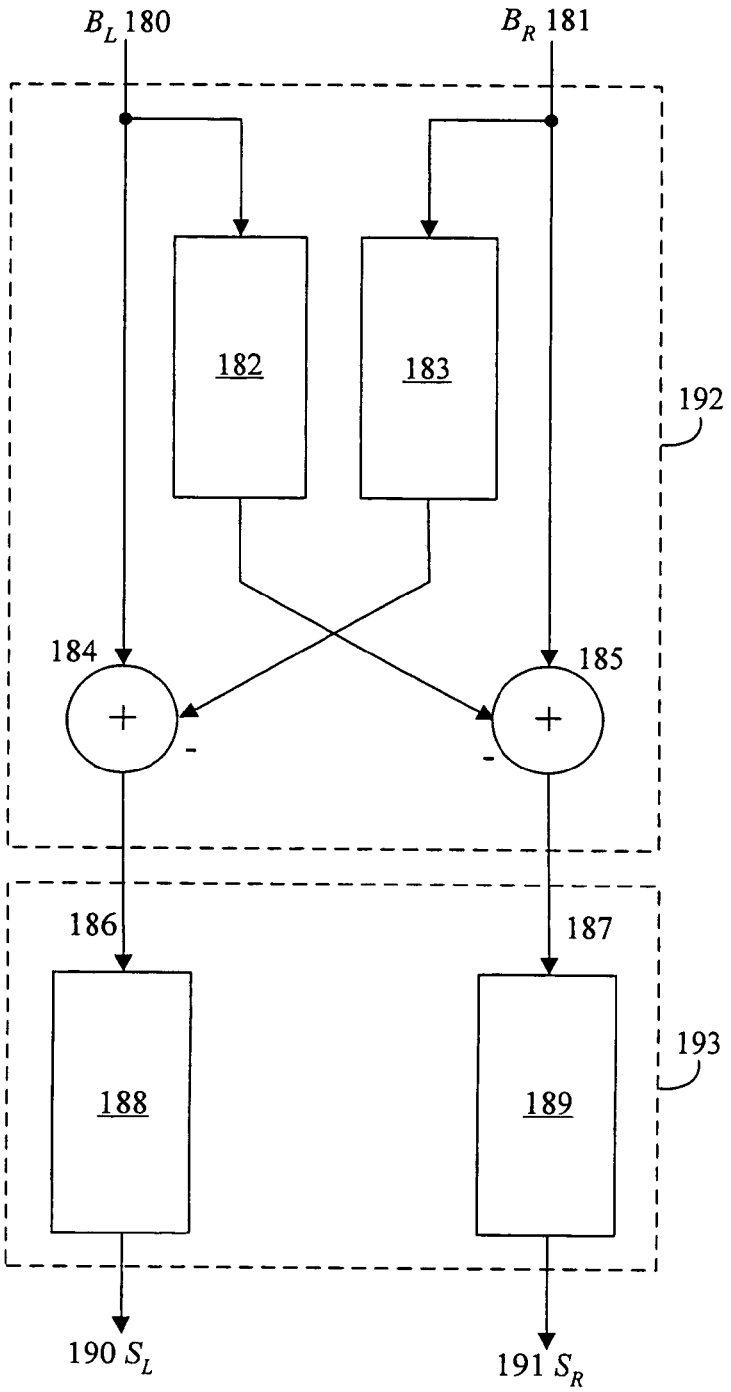
FIG. 8 shows a butterfly crosstalk canceler.

The corresponding canceler may be implemented in two stages using the butterfly architecture shown in FIG. 8. The first stage 192 is referred to as the crosstalk remover or mixing stage, and adds to each binaural channel a filtered version of the other binaural channel; its transfer function is given by $$R(\omega) = \begin{bmatrix} 1 & -r(\omega) \\ -r(\omega) & 1 \end{bmatrix}, \tag{15}$$

where r(ω) is referred to as the mixing filter. The second stage 193, which may be applied either before or after the first stage, equalizes the output, and is called the canceler equalization; its transfer function is $$Q(\omega)=q(\omega)I, \tag{16}$$

where I is the identity matrix, and q(ω) is the equalization filter. By setting the mixing filter to the transfer function ratio $$r(\omega)=\rho(\omega), \tag{17}$$

and the equalization filter to the product $$q(\omega)=1/[v(\omega)(1-\rho^2(\omega))], \tag{18}$$

the butterfly architecture of FIG. 8 will implement the canceler inverse.

Figure 9A:
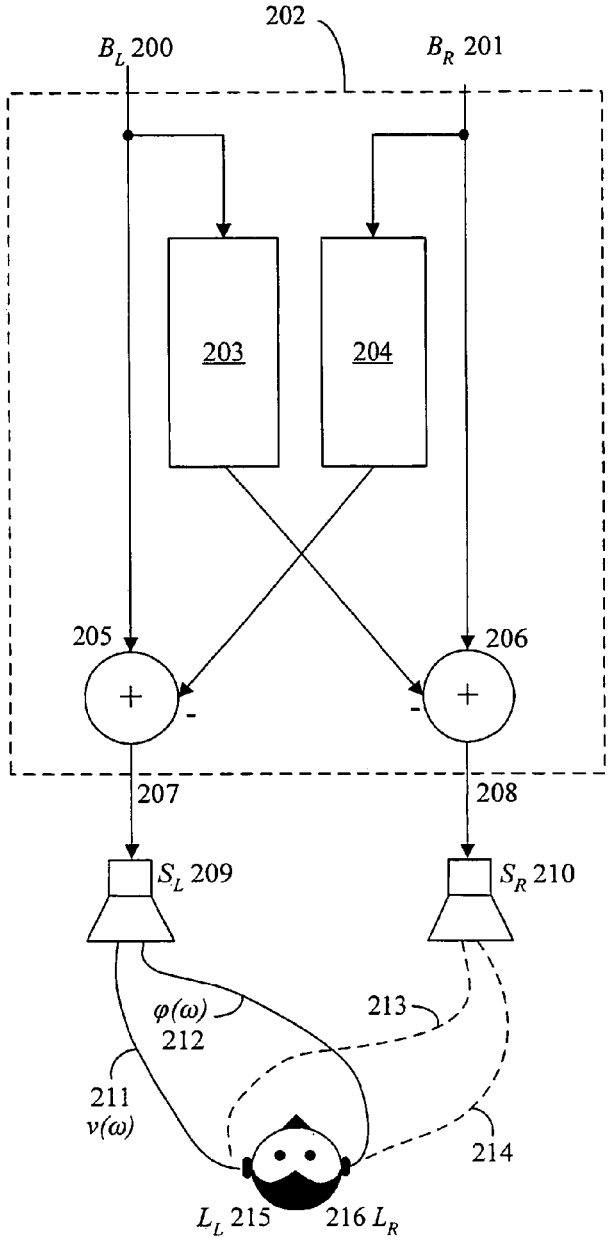
FIGS. 9*a* and 9*b* show a crosstalk remover example.
Figure 9B:
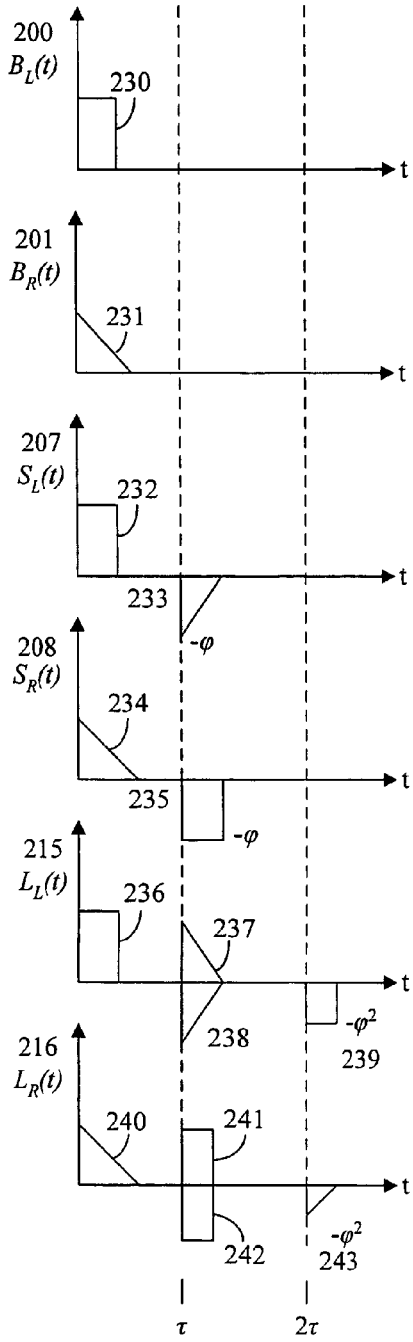

To understand the function of the mixing stage R(ω), consider the example shown in FIG. 9. Binaural signal channels 200 and 201 are applied to mixing stage 202, which produces speaker signals 207 and 208 in response. These signals propagate to the listener, appearing as listener ear signals 215 and 216. For purposes of illustration, the near-ear transfer function here is one v(ω)=1, and the far-ear transfer function is a scaled pure delay $\phi(\omega)=\rho e^{-j\omega\tau}$. In this example, the mixing filter r(ω) is set to the transfer function ratio $\rho(\omega)=\phi(\omega)/v(\omega)=\rho e^{-j\omega\tau}$.

Referring to FIG. 9, pulse 230 applied to the left binaural channel appears directly at the left speaker as pulse 232. It also appears delayed and scaled according to −ρ(ω) at the right speaker as pulse 235. The listener left ear will hear pulse 232 directly from the left speaker via near-ear transfer function 211 v(ω)=1. The left ear will also hear pulse 235, delayed and scaled according to far-ear transfer function 213 $\phi(\omega)=\rho e^{-j\omega\tau}$. The listener right ear will hear pulse 232 from the left speaker via far-ear transfer function 212, and pulse 235 directly via near-ear transfer function 214.

Note that pulses 241 and 242 arriving at the right ear cancel. Pulse 241 arriving from the left speaker via far-ear transfer function 213 is delayed and scaled by the same amount as pulse 235 by mixing filter 203 and near-ear transfer function 214. Therefore, signals applied to left binaural input 200 do not appear at the listener's right ear. Similarly, right binaural channel signals will be canceled at the listener's left ear. More generally, when the mixing filter r(ω) is set to the ratio of the near-ear and far-ear transfer functions, binaural signals processed according to the mixing stage (15) will appear at the listener's ears without crosstalk.

Figure 11:
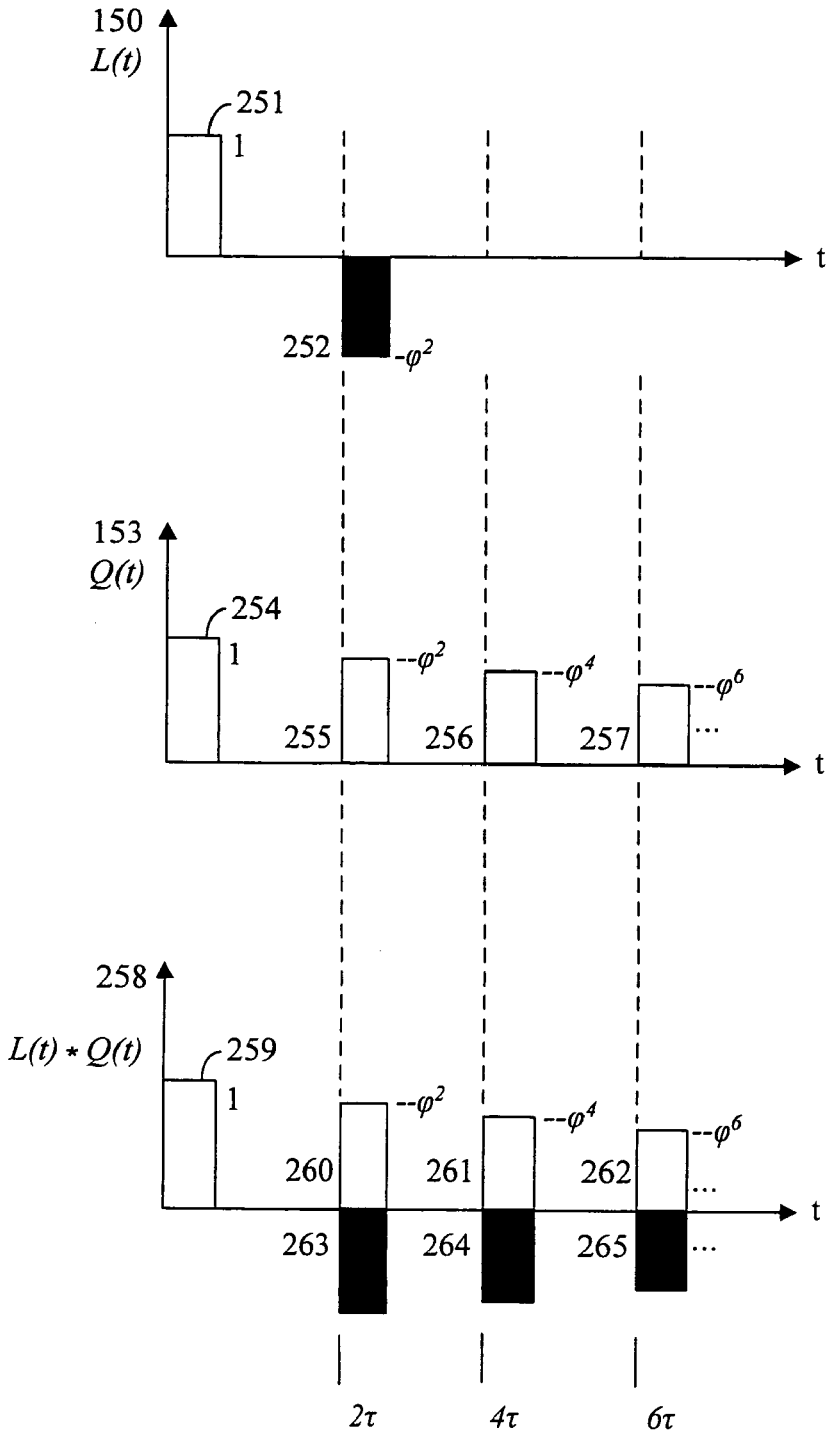
FIG. 11 shows a crosstalk equalization example.

Note that listener ear signals 215 and 216 are not the original binaural signal channels 200 and 201; each ear contains an echo of its respective binaural channel 239 and 243 as a residual effect of canceling crosstalk. The purpose of the equalization is now clear: In addition to inverting the near transfer function (referred to as "naturalization" in [3, 4]), the equalizer must eliminate the echo. As shown in FIG. 11, the echo at the listener ear may be removed by adding a series of echoes to the binaural signal. If the echoes are properly spaced in time and filtered, then the chain binaural signal echoes arriving from the far speaker will exactly cancel all but the first of the binaural signal instances arriving directly from the near speaker.

Inventive Crosstalk Removal

Figure 10:
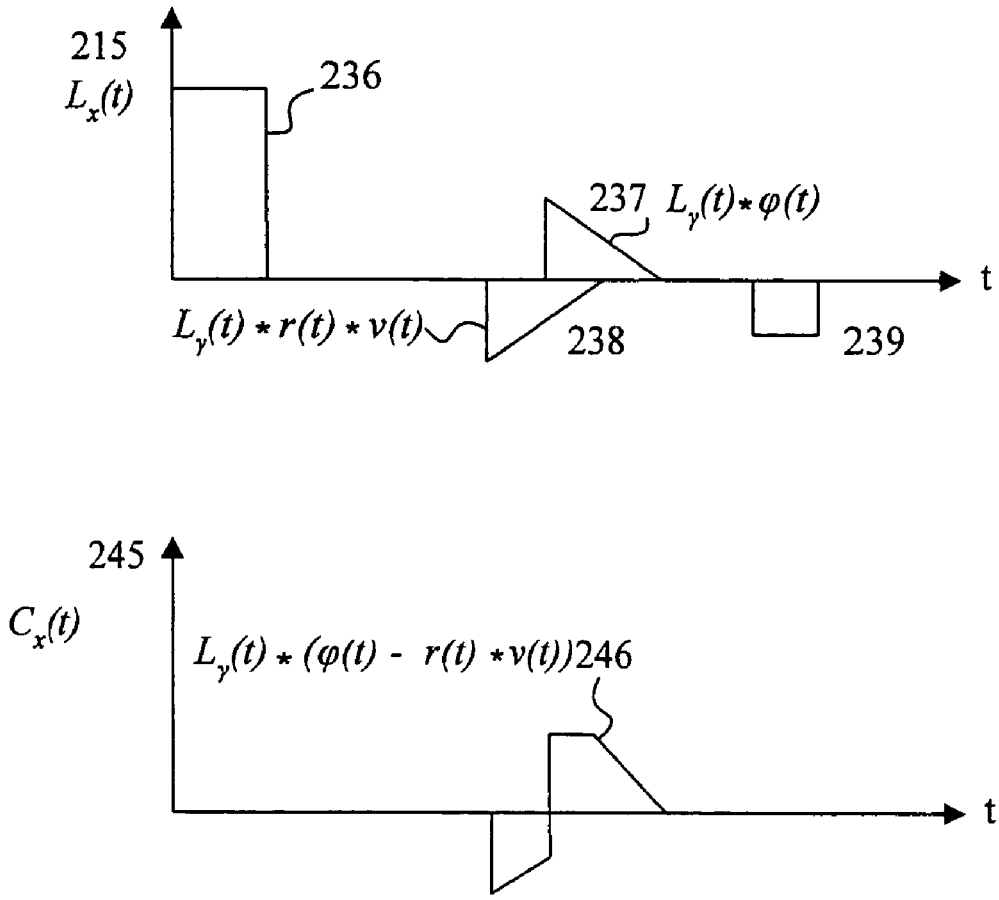
FIG. 10 shows an incomplete crosstalk cancellation example.

The canceler sensitivity to listener position and listener acoustic characteristics discussed above is seen to result from discrepancies between the mixing filter r(ω) and the transfer function ratio ρ(ω). As illustrated in FIG. 10, the crosstalk signal is the crosstalk binaural channel (i.e., the left binaural channel at the right ear or the right binaural channel at the left ear) filtered by φ(ω)−r(ω)v(ω). As the listener moves, the transfer functions φ(ω) and v(ω) change, and, unless those changes are anticipated by the mixing filter r(ω), the canceling signal radiated from the near-ear speaker will not cancel crosstalk from the far-ear speaker.

To give the listener some freedom of movement while maintaining effective (though not complete) crosstalk cancellation, Cooper and Bauck set the mixing filter to a low-pass filtered version of the transfer function ratio, r(ω)=ρ(ω)h(ω), h(ω) being a low-pass filter with a cutoff frequency above 600 Hz and below 10 kHz. In doing so, crosstalk is canceled only below the cutoff frequency. However, since low frequencies have relatively long wavelengths, ρ(ω) is somewhat insensitive to listener position at low frequencies. As a result, the listener is afforded a degree of freedom of movement without noticeably changing canceler effectiveness.

The present invention gives the listener freedom of movement by canceling different frequency bands at different listener positions. For instance, low frequencies might be canceled at a speaker separation angle of $\theta=10°$, and high frequencies at an angle of $\theta=30°$. Doing so provides a measure of cancellation over a range of anticipated listener positions; listener position changes do not eliminate cancellation, but simply shift the part of the signal canceled. An additional benefit of distributing the cancellation location is that a smooth transition between regions of effective cancellation and no cancellation is created.

Figure 29:
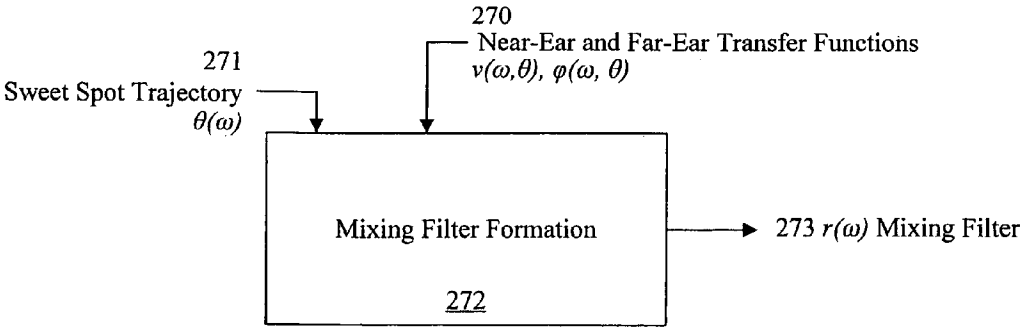
FIG. 29 shows a system for mixing filter evaluation.

Changing the cancellation geometry as a function of frequency may be accomplished by setting the mixing filter to the transfer function ratio evaluated at a frequency-dependent geometry as shown in FIG. 29, $$r(\omega)=\rho(\omega,\theta(\omega)), \tag{19}$$

where $\theta(\omega)$, called the sweet spot trajectory, specifies the frequency-dependent crosstalk geometry at which the transfer function ratio is evaluated. The mixing filter thus designed can be implemented directly as mixing filter 182 and 183 in mixing stage 192 of the butterfly canceler in FIG. 8. It can also be used in forming the canceler matrix $X(\omega)$, and implemented as a lattice, shuffler, or other canceler. Equivalently, shuffler or lattice cancelers, (12) or (9), or other cancelers, may be designed directly based on a frequency-dependent geometry.

Figure 13:
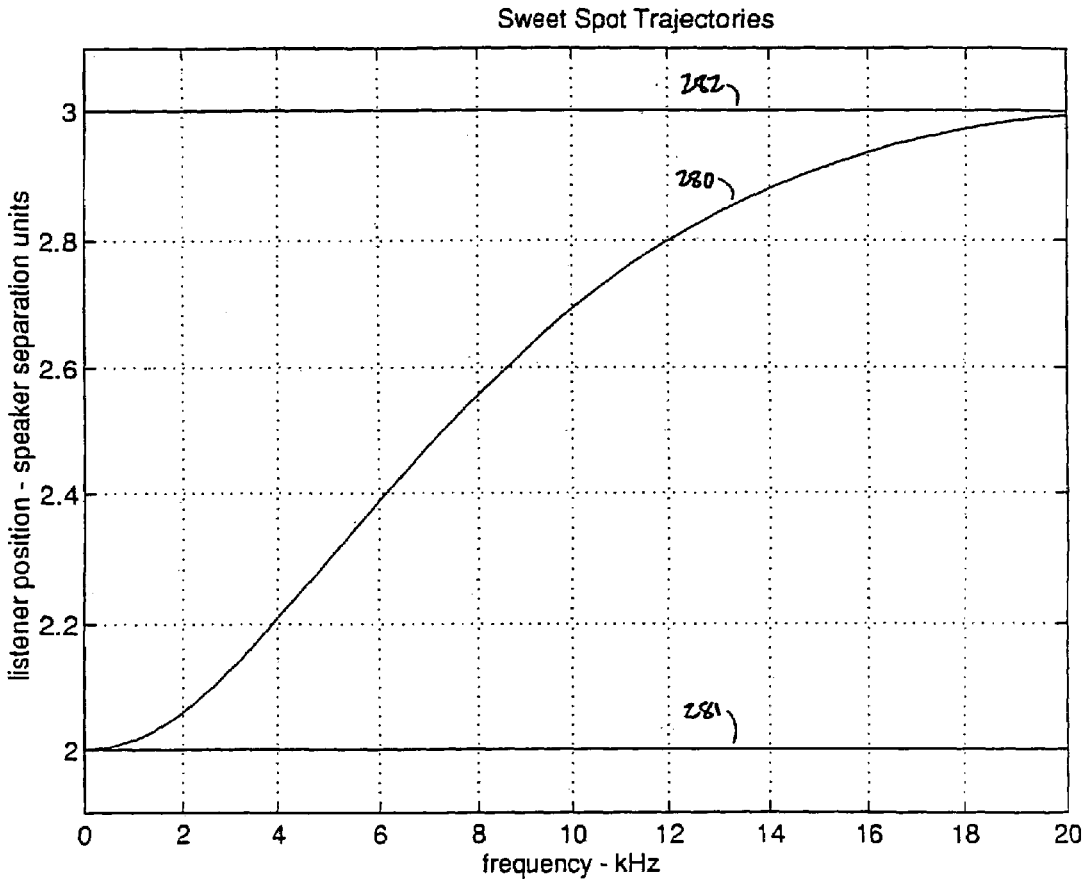
FIG. 13 shows an inventive sweet spot position example.

Details of the sweet spot trajectory $\theta(\omega)$ depend on, among other factors, the desired listener and speaker positions, and the binaural source material. In one embodiment, shown in FIG. 13, the sweet spot center is moved further from the speakers with increasing frequency. By changing the sweet spot center location more rapidly with decreasing frequency, this embodiment attempts to maintain a constant, but acceptable, level of crosstalk within the extended sweet spot. In another embodiment, the magnitude and phase of the mixing filter are determined from separate sweet spot center trajectories.

Figure 14:
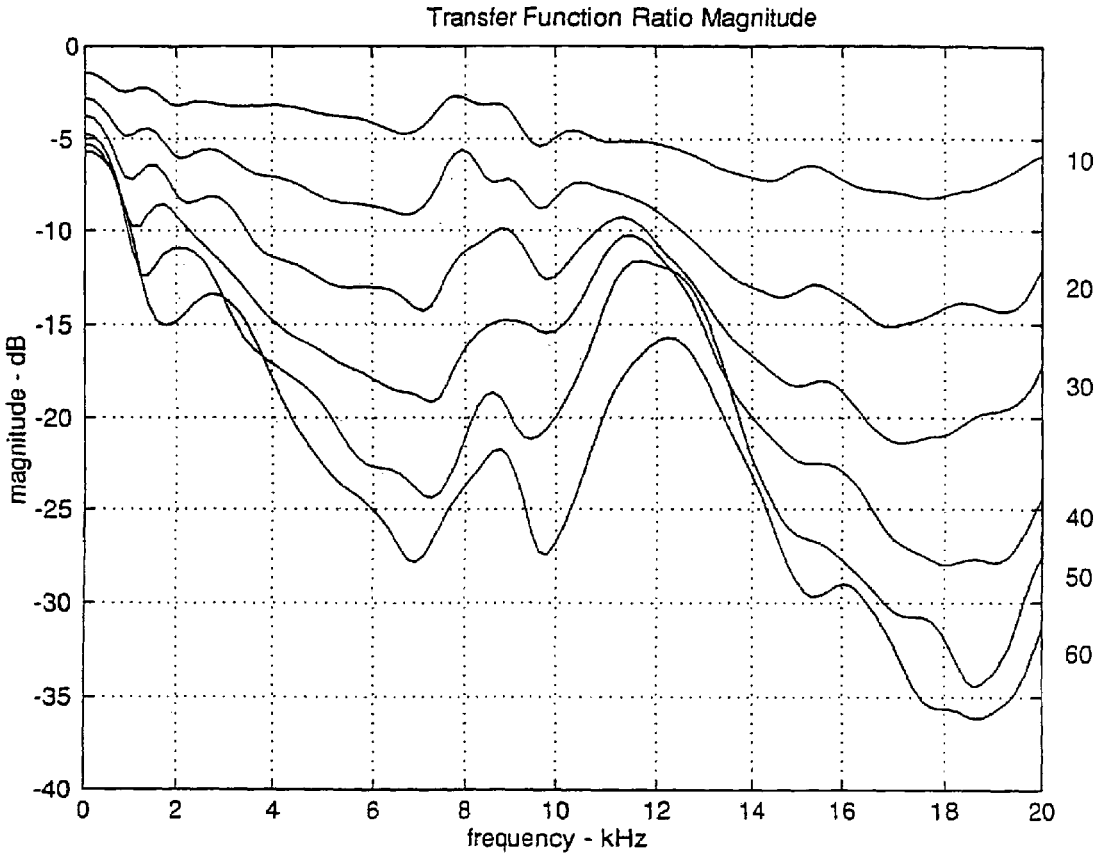
FIG. 14 shows example transfer function ratio magnitudes.
Figure 15:
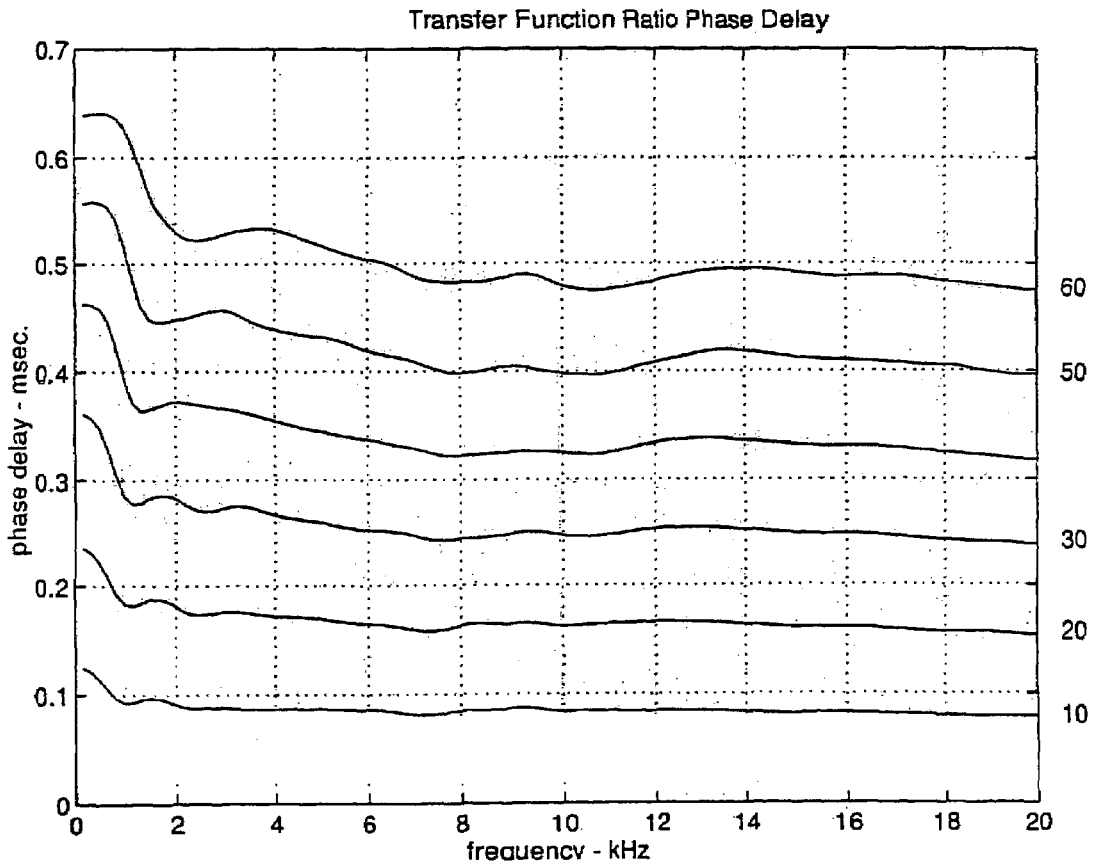
FIG. 15 shows example transfer function ratio phase delays.
Figure 16A:
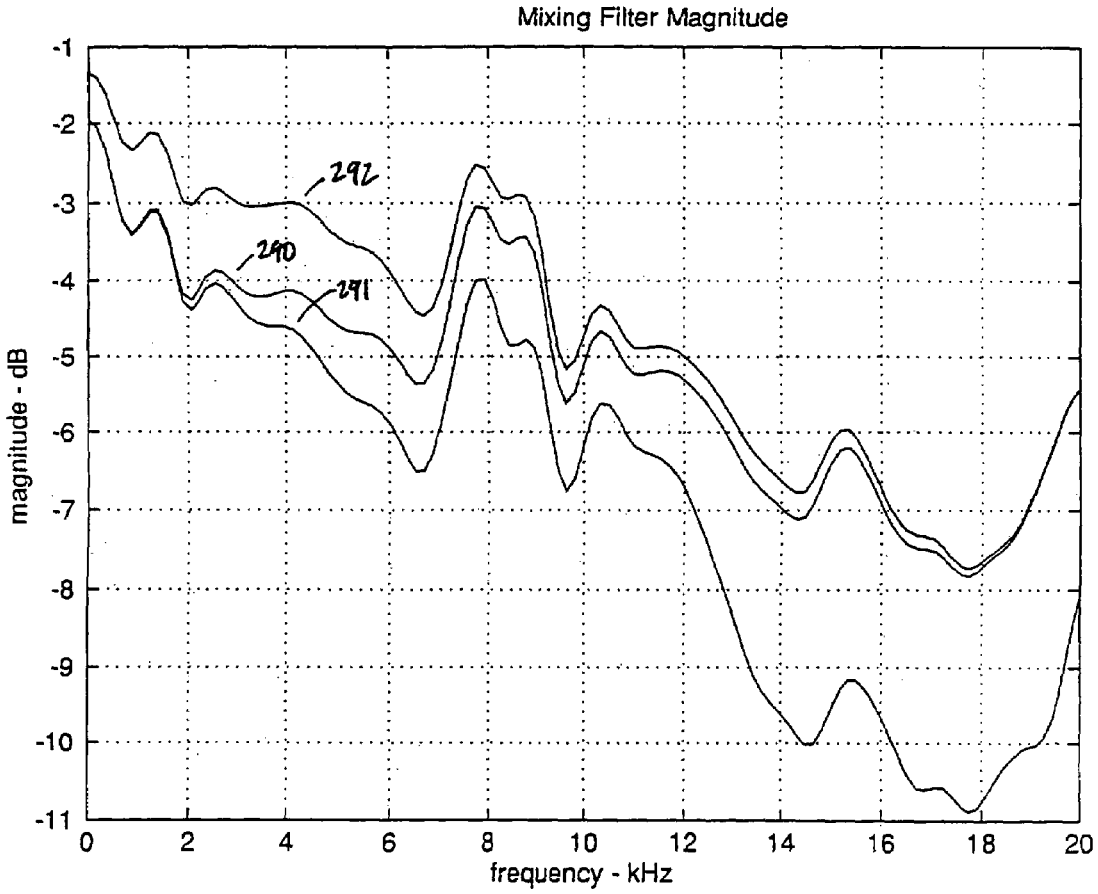
FIGS. 16*a* and 16*b* show an inventive mixing filter example.
Figure 16B:
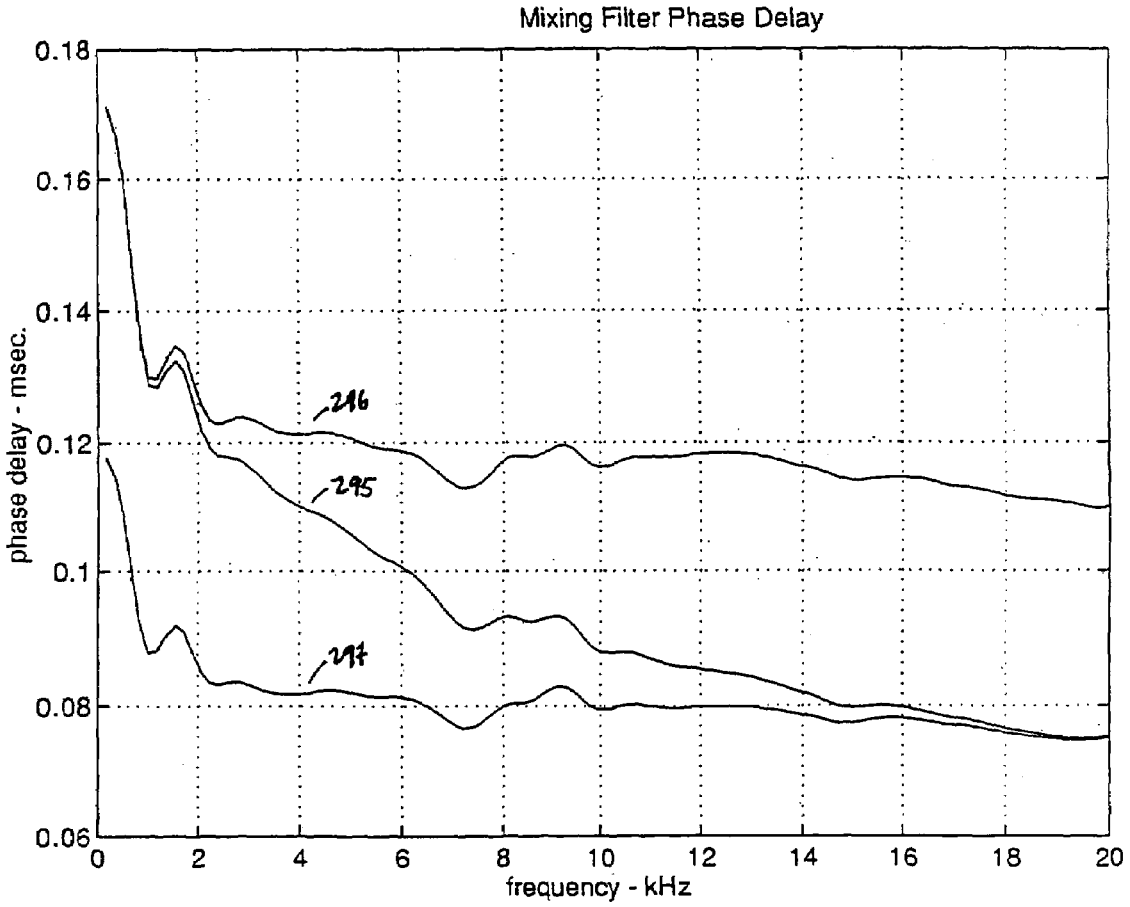

In FIG. 14 and FIG. 15, example transfer function ratio magnitudes and phase delays are shown as functions of frequency for listener positions along the listener axis. Mixing filters based on the inventive sweet spot trajectory 280 and prior art constant sweet spot trajectories 281, 282 are shown in FIG. 16. Note that the inventive mixing filter takes on the characteristics of the closer prior art filter at low frequencies and those of the farther prior art filter at high frequencies.

Figure 17:
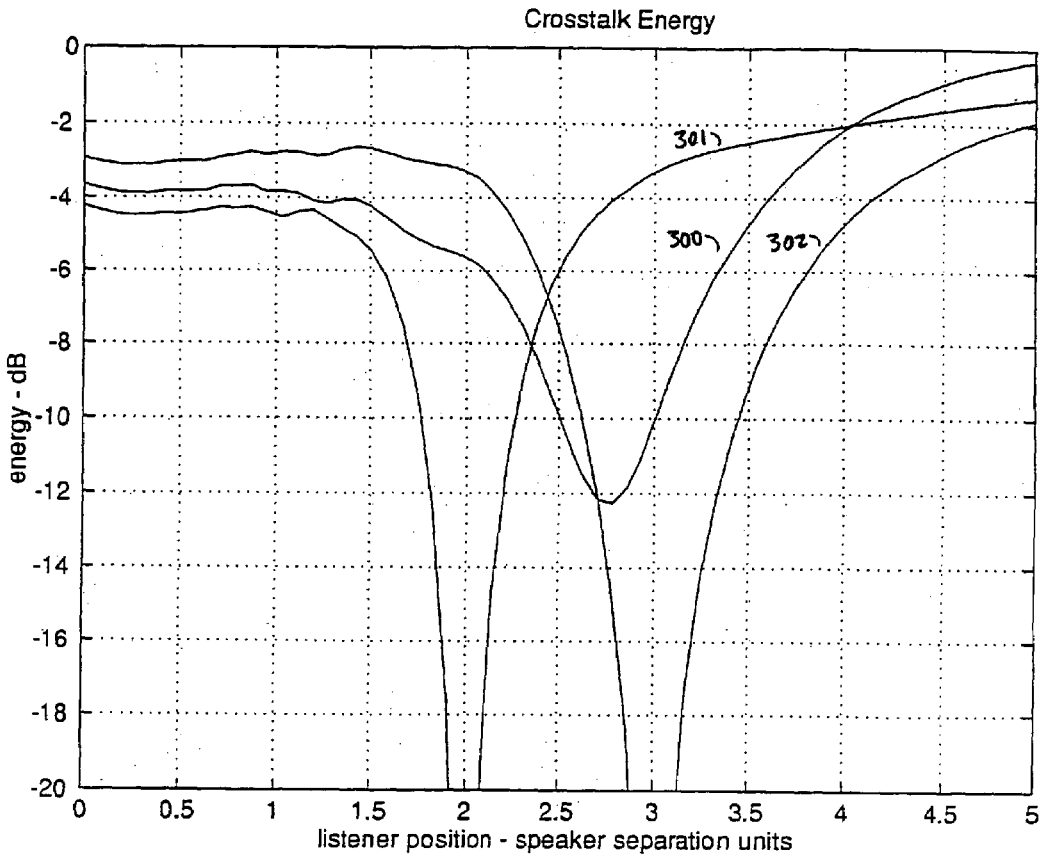
FIG. 17 shows sweet spot crosstalk energy.

The total energy in the crosstalk signal at an ear of a listener positioned at $\theta$ is given by $$E_c(\theta)=\int_0^{\pi}|v(\omega,\theta)r(\omega)-\phi(\omega,\theta)|^2\,d\omega, \tag{20}$$

where $v(\omega,\theta)$ and $\phi(\omega,\theta)$ are the near-ear and far-ear transfer functions to the ear of the listener at $\theta$. The crosstalk energy is plotted in FIG. 17 for the mixing filters implied by the sweet spot center trajectories of FIG. 13. Note that the inventive sweet spot 300 is somewhat more extended than that of the prior art canceler 301 (corresponding to constant sweet spot 281), and of comparable extent to that of prior art canceler 302 (corresponding to constant sweet spot 282).

Figure 30:
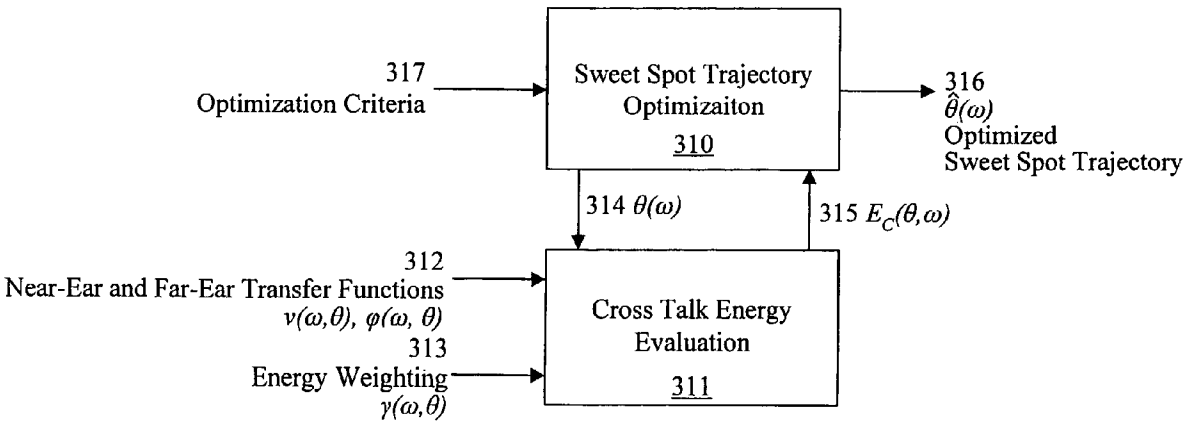
FIG. 30 shows a system for optimizing sweet spot trajectory.

In another embodiment of the invention, the sweet spot trajectory $\theta(\omega)$ is designed to maximize the area over which the listener can move while maintaining a minimum level of crosstalk rejection or maximum level of uncanceled crosstalk energy. In another embodiment, $\theta(\omega)$ is chosen to minimize the maximum crosstalk energy experienced by a listener located in a given region. In optimizing the sweet spot trajectory $\theta(\omega)$ as shown in FIG. 30, note that it may be useful to weight the crosstalk energy in frequency or position to give more importance to certain spectral bands or listener positions, or to account for the canceler equalization. For instance, the power spectrum of many sounds approximates a $1/\omega$ characteristic away from DC, so that in optimizing the sweet spot trajectory, it is useful to weight the crosstalk energy away from DC by $1/\omega$.

Figure 31:
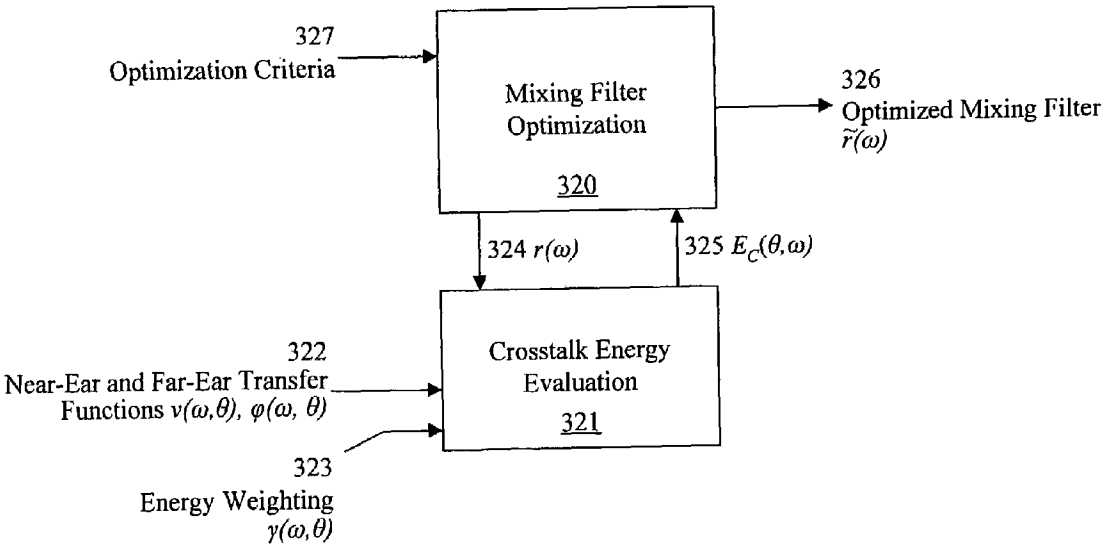
FIG. 31 shows a system for mixing filter optimization.

Another approach shown in FIG. 31 is to find the optimal mixing filter directly, rather than using $\theta(\omega)$ to parameterize the solution. In this embodiment of the invention, the crosstalk energy is written in terms of the mixing filter and the near-ear and far-ear transfer functions at each frequency and crosstalk geometry of interest, $$E_c(\theta,\omega)=\gamma(\omega)\cdot|v(\omega,\theta)r(\omega)-\phi(\omega,\theta)|^2, \tag{21}$$

where $\gamma(\omega)$ represents the product of the equalization filter power and the anticipated signal power at frequency $\omega$. The mixing filter $r(\omega)$ is then taken to be the one optimizing some aspect of the crosstalk energy $E_c(\theta,\omega)$. One choice is to minimize the maximum weighted energy over some set of canceler geometries or listener characteristics, $$\hat{r}(\omega)=\mathrm{Arg}\left[\min_{r(\omega)}\left\{\max_{\theta\in\Theta}\left\{\int_0^{\pi}w(\theta,\omega)E_c(\theta,\omega)d\omega\right\}\right\}\right], \tag{22}$$

where $\omega(\theta,\omega)$ is a weighting reflecting the importance of eliminating crosstalk energy at frequency $\omega$ and geometry $\theta$, and $\Theta$ represents the range of canceler geometries and listener characteristics under consideration. Another choice is to maximize the area over which the weighted crosstalk energy is less than a given level, $$\hat{r}(\omega)=\mathrm{Arg}\left[\max_{r(\omega)}\left\{\int_{\theta\in\Theta}1\left(\int_0^{\pi}w(\theta,\omega)E_c(\theta,\omega)\,d\omega<v(\theta)\right)d\theta\right\}\right], \tag{23}$$

where $1(\cdot)$ is an indicator function, taking on a value of 1 if the condition is true and 0 otherwise, and the quantity $v(\theta)$ specifies the maximum acceptable crosstalk energy level as a function of position. Alternatively, the maximum acceptable crosstalk energy level could depend on frequency as well as position, $$\hat{r}(\omega)=\mathrm{Arg}\left[\max_{r(\omega)}\left\{\int_{\theta\in\Theta}\int_0^{\pi}1(E_c(\theta,\omega)<v(\theta,\omega))\,d\omega\,d\theta\right\}\right]. \tag{24}$$

Still another optimization choice is to find the mixing filter minimizing the total crosstalk energy in a given region, $$\hat{r}(\omega) = \mathrm{Arg}\left[\min_{r(\omega)}\left\{\int_{\theta\in\Theta}\int_0^{\pi} w(\theta,\omega)E_c(\theta,\omega)\,d\omega\,d\theta\right\}\right], \tag{25}$$

where the weighting $\omega(\theta,\omega)$ weights the importance of having effective cancellation at a given frequency and speaker-listener geometry.

Figure 18A:
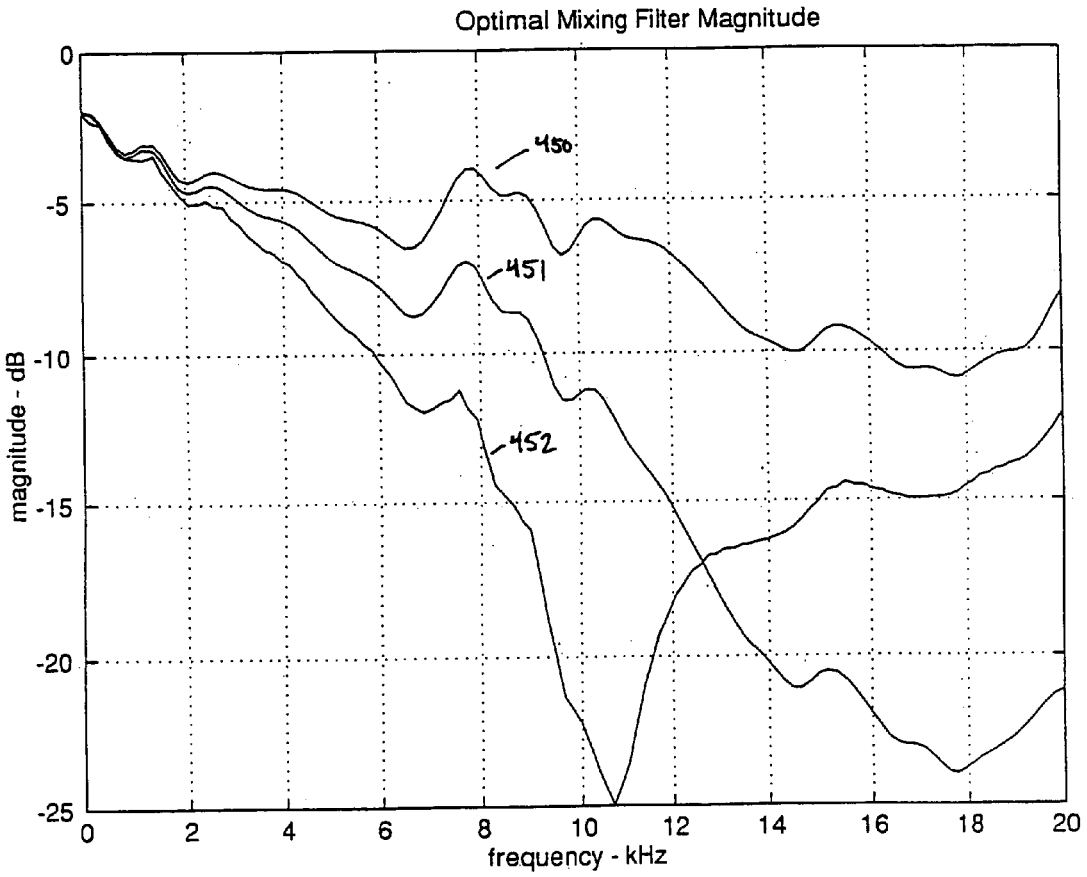
FIGS. 18*a* and 18*b* show an inventive mixing filter example.
Figure 18B:
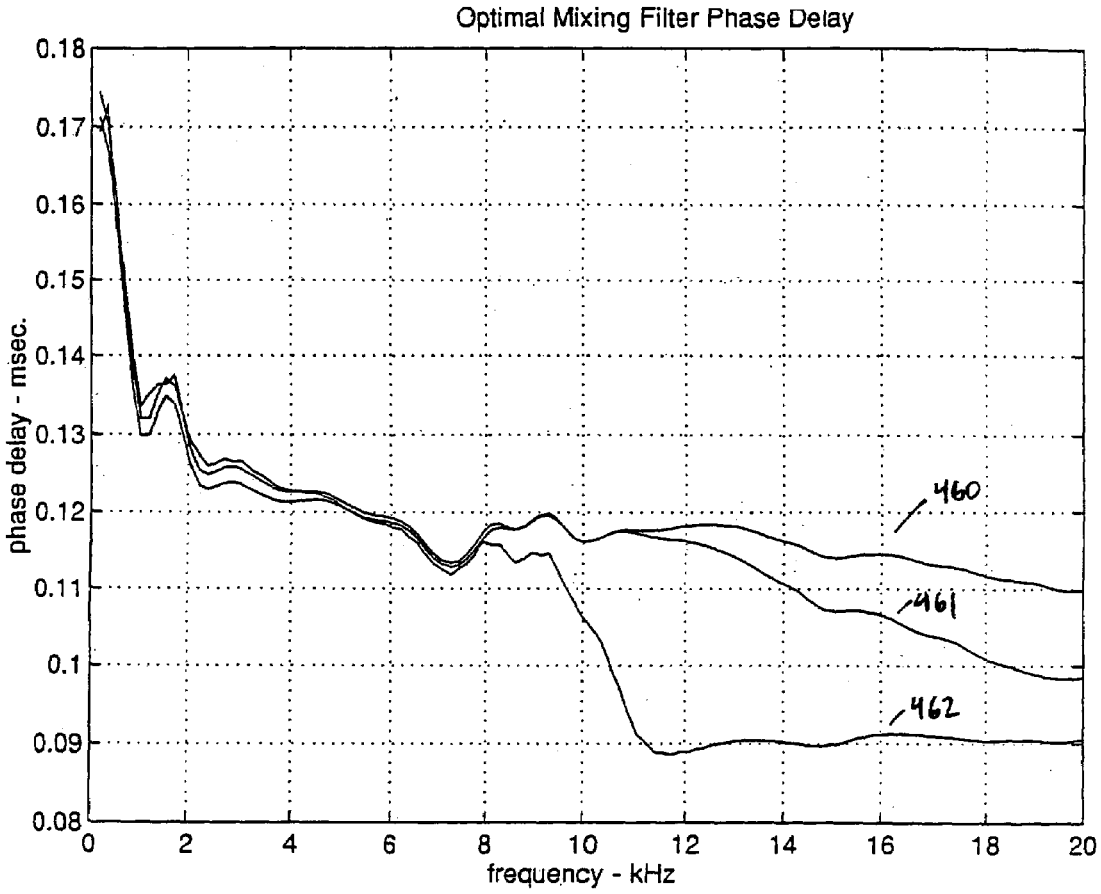
Figure 19:
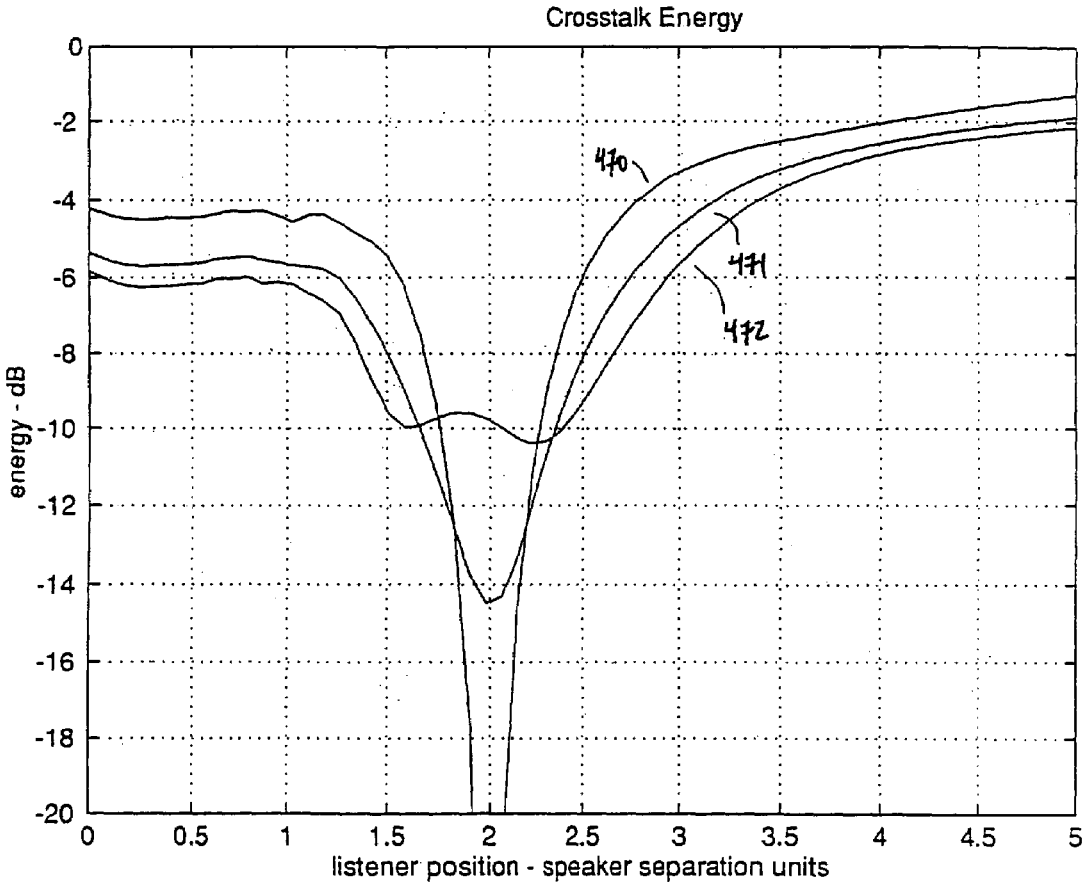
FIG. 19 shows example sweet spot crosstalk energy.

As an example, FIG. 18 shows the magnitude 450 and phase delay 460 of the prior art mixing filter designed to cancel crosstalk at the ears of a listener positioned on the listener axis twice as far from the line joining the speakers as the distance separating the speakers. Also shown are the magnitude and phase delay of the filter minimizing the total crosstalk energy (25) 451, 461 and minimizing the maximum crosstalk energy (22) 452, 462 for listeners on the listener axis between 1.5 and 2.5 times the speaker separation from the speaker axis. Note that magnitude of the optimal mixing filters is similar to that of prior art mixing filters for listener positions closer to the speakers than that used to generate prior art mixing filter magnitude 450. By contrast, the phase delay of the inventive mixing filters is more like that of prior art mixing filters associated with positions further from the speakers than that used to form prior art mixing filter phase delay 460. The crosstalk energy associated with the inventive and prior art mixing filters of FIG. 18 is plotted as a function of position in FIG. 19. The minimizer of the maximum crosstalk energy over the region 452, 462 provides the widest sweet spot 472. The prior art crosstalk has the smallest sweet spot 470 and the most abrupt transition between regions of effective cancellation and little cancellation.

Another optimization choice is suggested by the observation that listeners prefer cancelers having a gentle transition between areas of effective cancellation and no cancellation over cancelers with a more abrupt transition. To accommodate this preference, the mixing filter may be optimized so that the slope (derivative with respect to position) of the crosstalk energy in the transition region is minimized.

It should be noted that the optimal mixing filter $\hat{r}(\omega)$ (25) may be expressed in closed from, $$\hat{r}(\omega) = \frac{\mu_\phi(\omega)\mu_\nu(\omega)^* + \sigma_{\phi\nu^*}(\omega)}{\mu_\nu(\omega)\mu_\nu(\omega)^* + \sigma_{\nu\nu^*}(\omega)}, \tag{26}$$

where $\cdot^*$ denotes complex conjugation, $\mu_\phi(\omega)$ and $\mu_\nu(\omega)$ are the near-ear and far-ear transfer function means over position, $$\mu_\phi(\omega)=\int\omega(\theta,\omega)\phi(\omega,\theta)d\theta, \tag{26}$$

$$\mu_\nu(\omega)=\int\omega(\theta,\omega)\nu(\omega,\theta)d\theta, \tag{28}$$

and $\sigma_{\nu\nu}^*(\omega)$ and $\sigma_{\phi\nu}^*(\omega)$ are variances over position, $$\sigma_{\nu\nu}^*(\omega)=\int\omega(\theta,\omega)|\nu(\omega)-\mu_\nu(\omega)|^2d\theta, \tag{29}$$

$$\sigma_{\phi\nu}^*(\omega)=\int\omega(\theta,\omega)[\phi(\omega)-\mu_\phi(\omega)][\nu(\omega)-\mu_\nu(\omega)]^*d\theta, \tag{30}$$

Figure 32:
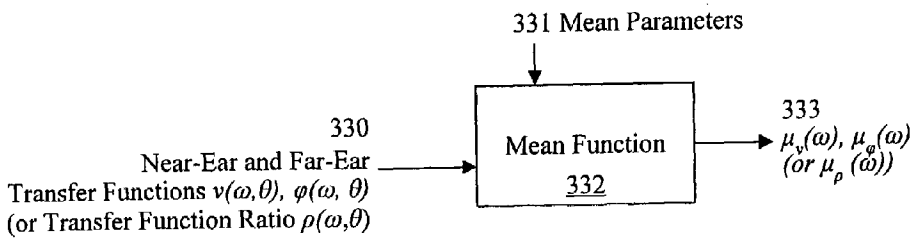
FIG. 32 shows a system for computing transfer function means.

Note that the optimal mixing filter has a magnitude and phase approximating that of the mean over position of the transfer function ratio $\rho(\omega,\theta)$, with the magnitude reduced at frequencies where the transfer function ratio changes rapidly with position. This motivates another embodiment of the invention shown in FIG. 32, wherein the magnitude or phase of the mixing filter is given by the respective means over position of the magnitude or phase of the transfer function ratio filter, possibly reducing the mixing filter magnitude at any selected frequency by an amount dependent on the transfer function ratio position variance (i.e., the sensitivity of the transfer function ratio to changes in listener position) at that frequency.

Inventive Equalization

Listener freedom of movement is also restricted by the canceler equalization. As illustrated in FIG. 11, the equalization associated with the crosstalk matrix inverse removes the unwanted binaural signal echo by creating two chains of canceling echoes. Unfortunately, as shown in FIG. 12, the resulting listener ear signals are very sensitive to listener position, which determines the relative alignment and strength of the two chains through the near-ear and far-ear transfer functions.

What is needed is to balance the desire to maintain the original binaural signal equalization with the need to accommodate varying crosstalk geometries and listener characteristics. The inventive canceler equalization achieves this balance by optimizing the equalization over a set of anticipated listener positions and characteristics. This approach differs from that of the prior art which uses a single crosstalk geometry in designing the canceler equalization.

The binaural channel signal appearing at the ear of the listener is filtered by $$q(\omega)(\nu(\omega,\theta)-\phi(\omega,\theta)r(\omega)),$$

$q(\omega)$ being the canceler equalization filter, $r(\omega)$ the canceler mixing filter, and $\nu(\omega,\theta)$ and $\phi(\omega,\theta)$ the near-ear and far-ear transfer functions evaluated at the crosstalk geometry and listener characteristics $\theta$. Ideally, the binaural channel would appear at the listener unfiltered; the energy in the difference between the unit transfer function and that imposed on the binaural channel, called the equalization residual is given by $$E_q(\omega,\theta)=|q(\omega)(\nu(\omega,\theta)-\phi(\omega,\theta)r(\omega))-1|^2. \tag{31}$$

In one embodiment of the invention, the equalization $q(\omega)$ is optimized to minimize the equalization residual $E_q(\omega,\theta)$ over a distribution of crosstalk geometries and listener characteristics $\rho(\theta)$, $$\hat{q}(\omega) = \mathrm{Arg}\left[\min_{q(\omega)}\left\{\int_{\theta\in\Theta}\int_0^{\pi} \wp(\theta)E_q(\theta,\omega)\,d\omega\,d\theta\right\}\right], \tag{32}$$

This solution is available in closed form, $$\hat{q}(\omega) = \frac{\int\wp(\theta)(\nu(\omega,\theta)-\phi(\omega,\theta)r(\omega))d\theta}{\int\wp(\theta)|\nu(\omega,\theta)-\phi(\omega,\theta)r(\omega)|^2d\theta}. \tag{33}$$

Denoting by $\mu_\nu(\omega)$ and $\mu_\phi(\omega)$ the means of the near-ear and far-ear transfer functions with respect to $\rho(\theta)$, $$\mu_\phi(\omega)=\int\rho(\theta)\phi(\omega,\theta)d\theta, \tag{34}$$

$$\mu_\nu(\omega)=\int\rho(\theta)\nu(\omega,\theta)d\theta, \tag{35}$$

and by $\sigma_{\nu\nu}^*(\omega)$, $\sigma_{\phi\phi}^*(\omega)$, and $\sigma_{\phi\nu}^*(\omega)$ the variances with respect to $\rho(\theta)$ $$\sigma_{vv}^*(\omega)=\int \rho(\theta)|v(\omega)-\mu_v(\omega)|^2 d\theta, \tag{36}$$

$$\sigma_{\phi\phi}^*(\omega)=\int \rho(\theta)|\phi(\omega)-\mu_\phi(\omega)|^2 d\theta, \tag{37}$$

$$\sigma_{\phi v}^*(\omega)=\int \rho(\theta)[\phi(\omega)-\mu_\phi(\omega)][v(\omega)-\mu_v(\omega)]^* d\theta, \tag{38}$$

the optimal equalization may be written as $$\hat{q}(\omega) = \frac{1}{\mu_v(\omega)} \cdot \frac{1}{1 - r(\omega)\mu_\phi(\omega)/\mu_v(\omega) + \left[\frac{\sigma_{vv^*}(\omega) + |r(\omega)|^2\sigma_{\phi\phi^*}(\omega) - 2\Re\{r(\omega)\sigma_{\phi v^*}(\omega)\}}{\mu_v(\omega)\mu_v(\omega)^*(1 - r(\omega)\mu_\phi(\omega)/\mu_v(\omega))}\right]}, \tag{39}$$

where $R\{\cdot\}$ is the real part of its argument. By comparison to the prior art equalization, $$q(\omega) = \frac{1}{v(\omega)} \cdot \frac{1}{1 - r(\omega)\phi(\omega)/v(\omega)}, \tag{40}$$

the optimal equalization (39) generates similar train of echoes, but with a shorter time constant (since the bracketed term is nonnegative), particularly in those parts of the spectrum where the near-ear and far-ear transfer functions are sensitive to position changes. In the frequency domain, the magnitude of the optimal equalization will appear smoothed relative to that of the prior art equalization. Note that the greater the sensitivity to position changes or listener characteristics exhibited by $v(\omega)$ and $\phi(\omega)$, or the greater the range of expected geometries and listeners $\rho(\theta)$, the more smoothed the optimal equalization magnitude compared to the prior art equalization.

Figure 20A:
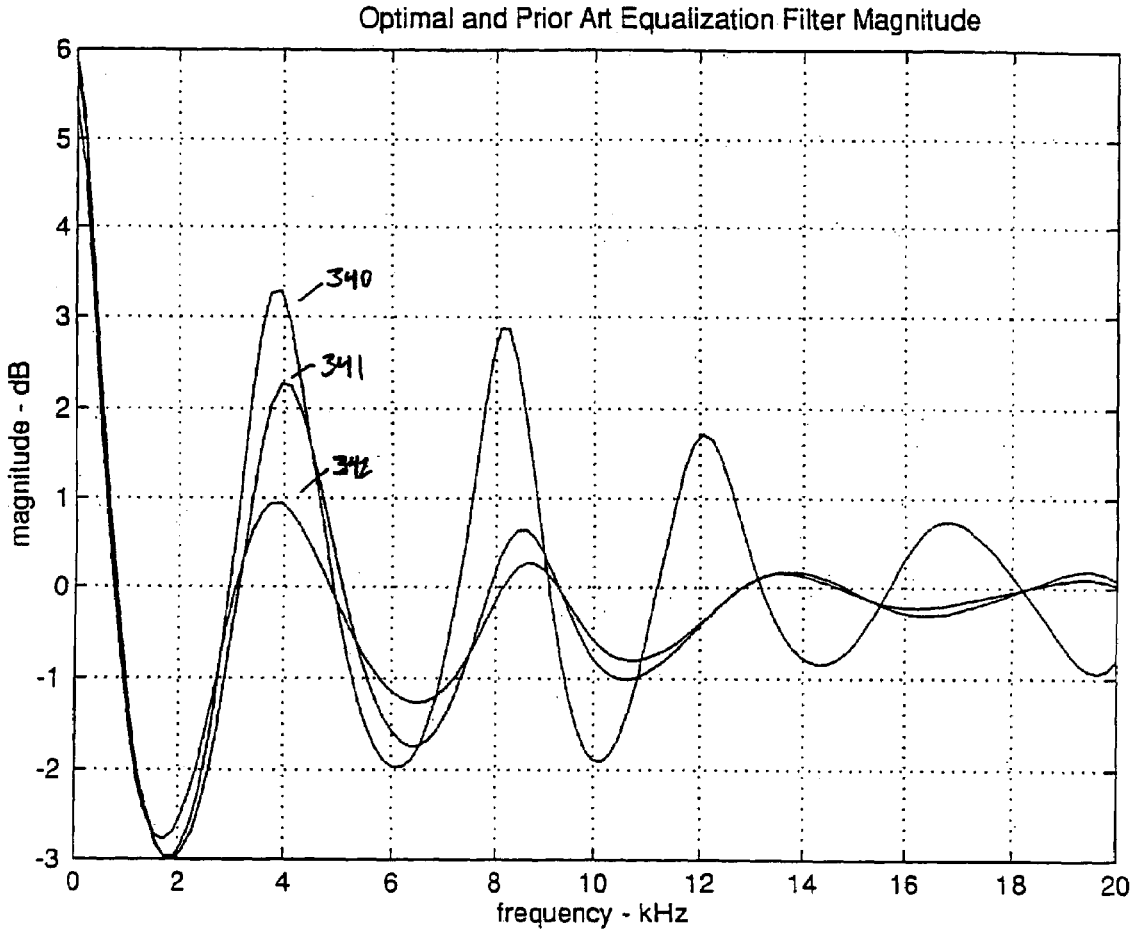
FIGS. 20*a* and 20*b* show example inventive residual energy minimizing equalization.
Figure 20B:
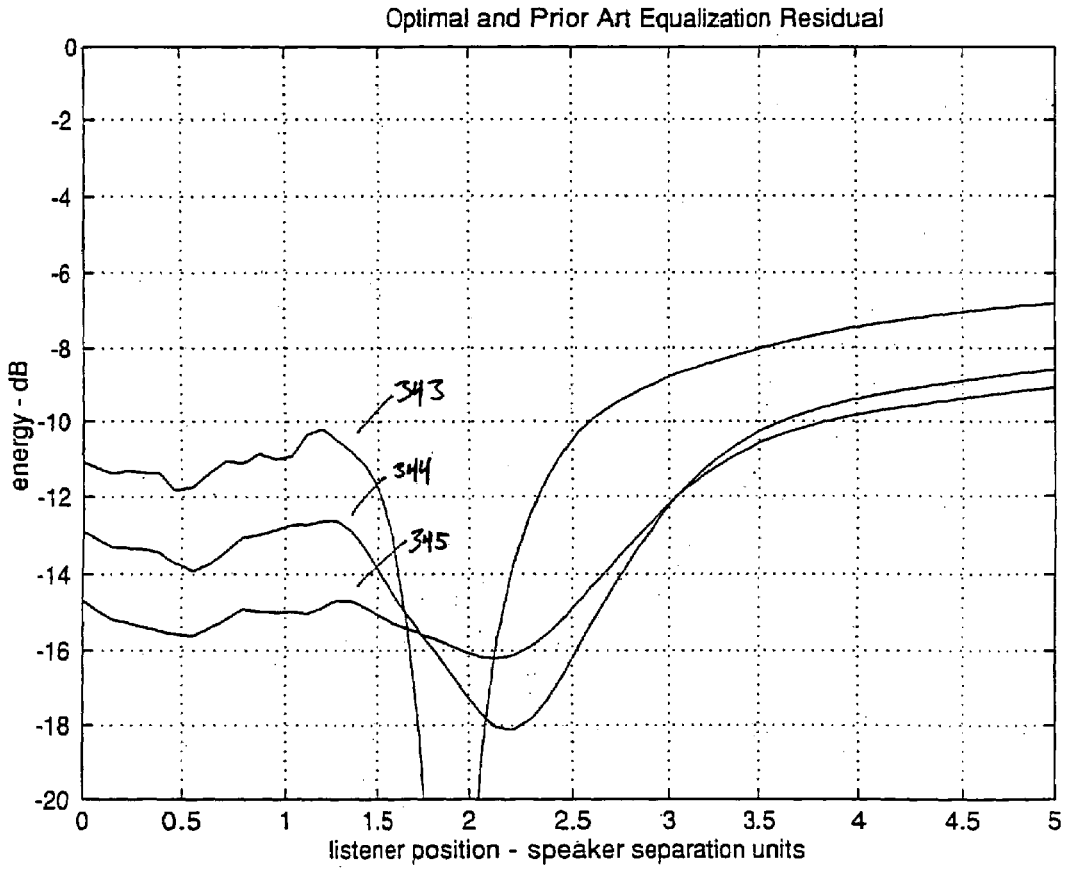

As an example, FIG. 20 shows the prior art equalization magnitude 340 along with that of two optimal equalizations. Equalization 341 is designed to minimize the expected equalization residual for listeners uniformly distributed on the listener axis between 1.5 and 2.5 times the speaker separation distance from the speaker axis; equalization 342 minimizes the equalization residual for listeners between 1.0 and 2.5 times the speaker separation from the speaker axis. The equalization residual as a function of listener position is also shown in FIG. 20. The inventive equalization residuals 344, 345 achieve their minima over wider ranges of listener position than does the prior art equalization residual 343. In addition, away from the sweet spot center, the inventive equalization residuals are smaller than the prior art equalization residual.

Figure 21:
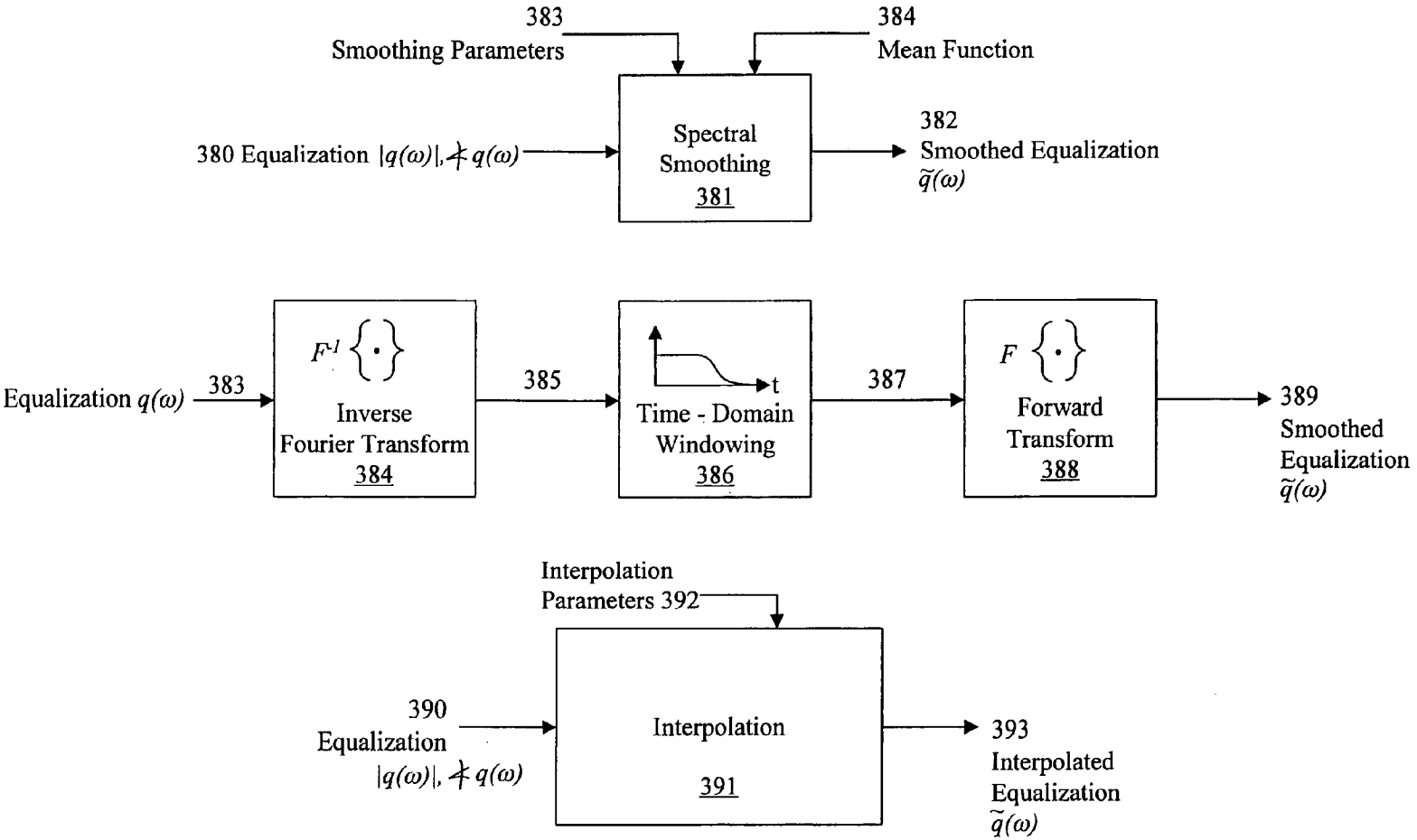
FIG. 21 shows inventive smoothed and interpolated equalizations systems.
Figure 24:
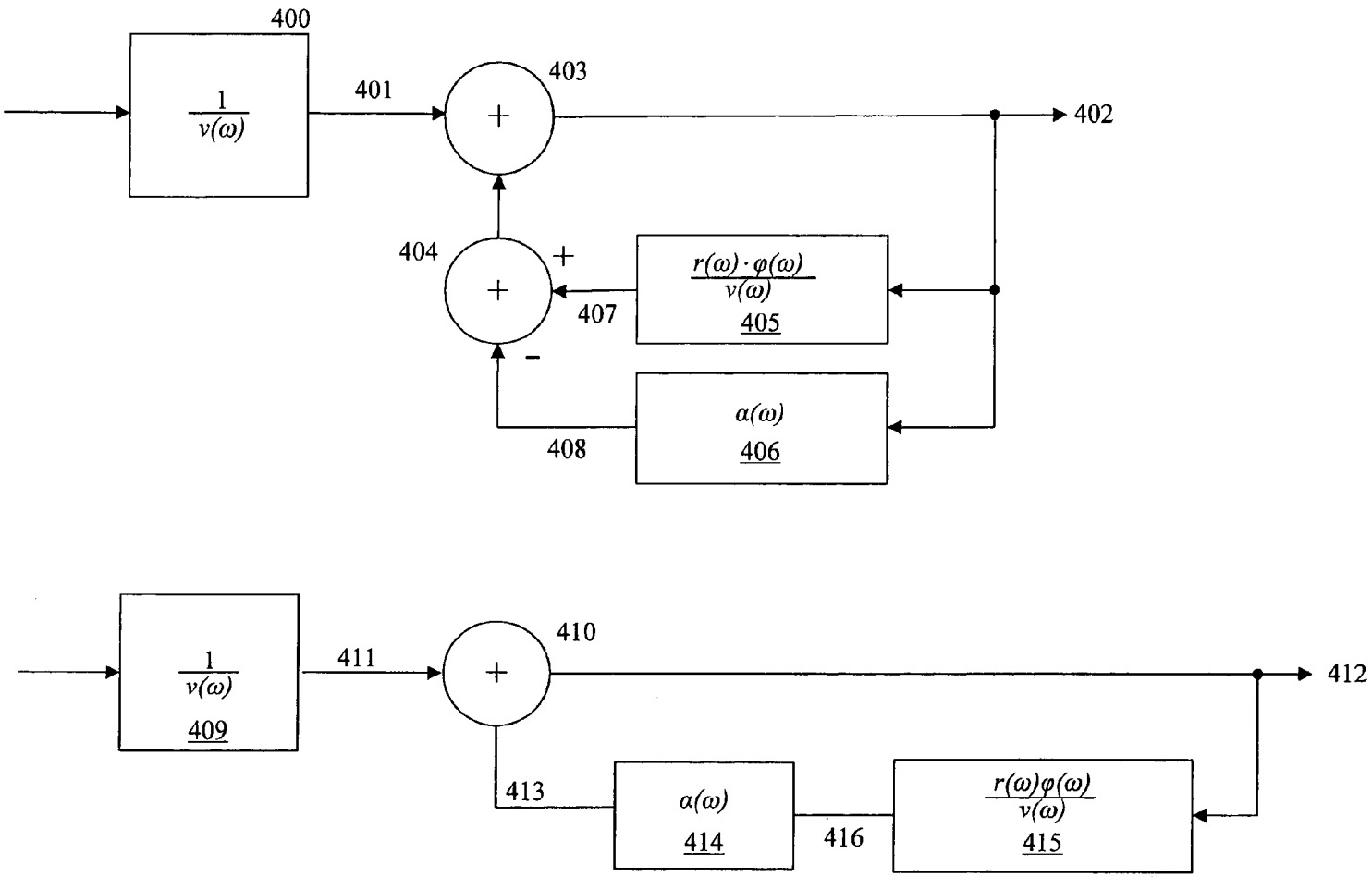
FIG. 24 shows inventive reduced feedback equalization systems.

The observation that the optimal equalization magnitude is essentially a smoothed version of the prior art equalization magnitude leads to the inventive equalizations shown in FIG. 21 and FIG. 24. In the embodiment shown in FIG. 21, the inventive canceler equalization spectrum is a smoothed or interpolated version of the spectrum of an input canceler equalization. Note that the smoothing or interpolation may be applied to the entire spectrum, or may be restricted to all but the naturalization, $1/|v(\omega)|^2$. A smoothed canceler equalization spectrum may be found by applying a running mean (arithmetic, geometric, trimmed or other means may be applied) to a prior art equalization spectrum $$|q(\omega)|^2 = \frac{1}{|v(\omega)|^2} \cdot \frac{1}{1 + |r(\omega)\phi(\omega)/v(\omega)|^2 - 2\Re\{r(\omega)\phi(\omega)/v(\omega)\}}. \tag{41}$$

Figure 22:
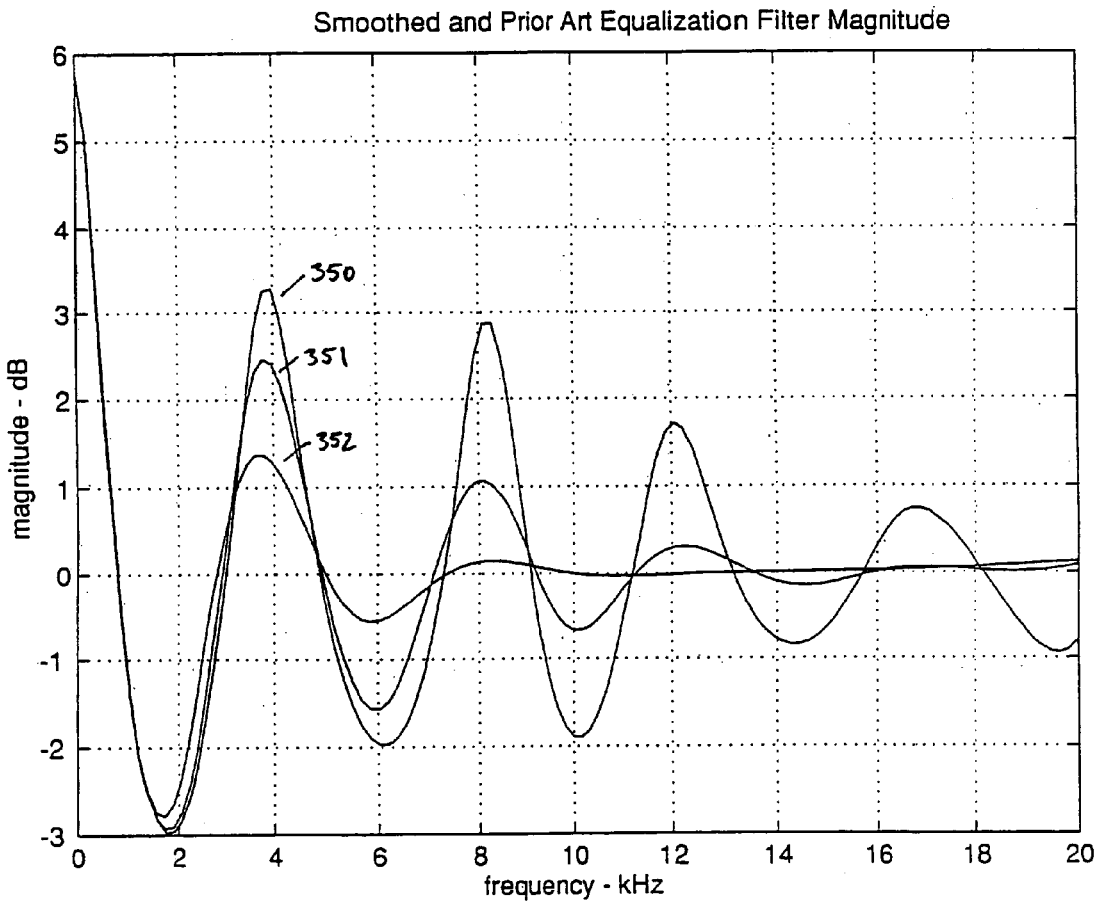
FIG. 22 shows a smoothed equalization example.

It may be equivalently found as the spectrum associated with the appropriately windowed version of the prior art equalization impulse response. In FIG. 22, example prior art equalization 350 is shown along with inventive smoothed equalizations 351, 352. Smoothed equalizations 351, 352 were formed by critical band smoothing of the prior art power spectrum using smoothing bandwidths of 1.0 and 2.0 critical bands, respectively.

Figure 23:
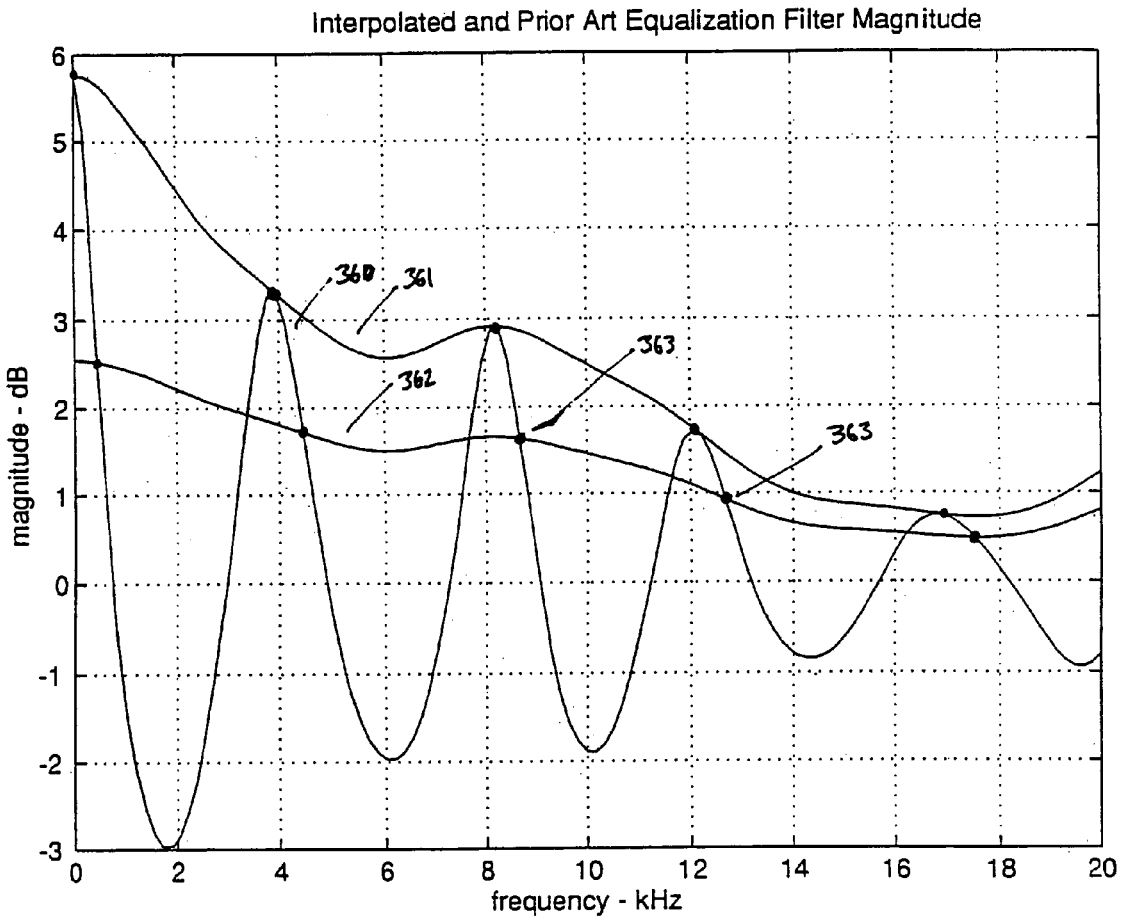
FIG. 23 shows an interpolated equalization example.

An interpolated spectrum may be found by interpolating in the prior art equalization power spectrum points where the quantity $r(\omega)\phi(\omega)/v(\omega)$ achieves the same phase. The resulting power spectrum is given by $$|\hat{q}(\omega)|^2 = \frac{1}{|v(\omega)|^2} \cdot \frac{1}{1 + |r(\omega)\phi(\omega)/v(\omega)|^2 - 2\alpha|r(\omega)\phi(\omega)/v(\omega)|}, \tag{42}$$

where $\alpha\epsilon[-1,1]$ which determines the points of the prior art equalization interpolated. Several example interpolated equalization magnitudes 361, 362 are plotted in FIG. 23 along with the prior art equalization magnitude 360; interpolation points 363 are marked.

The embodiment of FIG. 24 augments a prior art canceler equalization implementation with an additional filter $\alpha(\omega)$ which has the effect of reducing feedback, thereby smoothing the spectrum of the prior art canceler. So as to approximate the optimal equalization, feedback should be preferentially reduced in those frequency bands where the feedback is largest. In one instance, a filtered version of the output is added to the feedback path of the prior art equalization, $$\hat{q}(\omega) = \frac{1}{v(\omega)} \cdot \frac{1}{1 - r(\omega)\phi(\omega)/v(\omega) + \alpha(\omega)}, \tag{43}$$

where $\alpha(\omega)$ is a filter having a phase generally similar to that of $r(\omega)\phi(\omega)/v(\omega)$; it's presence selectively reduces decay time. In another instance, feedback is reduced directly, $$\hat{q}(\omega) = \frac{1}{v(\omega)} \cdot \frac{1}{1 - \alpha(\omega)r(\omega)\phi(\omega)/v(\omega)}, \tag{44}$$

where $\alpha(\omega)$ is a filter (preferably minimum phase) having a magnitude no greater than one; it reduces decay time by limiting the amount of feedback at any given frequency. Note that it is possible to adjust both instances of $\alpha(\omega)$ above so that the resulting equalization approximates the optimal equalization (39).

Another consideration in crosstalk canceler equalization is the apparent coloring of the binaural signal experienced by those listeners outside the sweet spot. To minimize equalization artifacts for these listeners, the approach taken here is to equalize the canceler so as to be compatible with—i.e., pass unchanged in equalization—certain classes of input signals. For example, many signals including virtual surround binaural signals have a large fraction of their energy common to both binaural channels. In this case, a crosstalk canceler equalized to pass unchanged monophonic signals would be appropriate. The response of a crosstalk canceler $X(\omega)=q(\omega)R(\omega)$ to a two-channel monophonic signal $b(\omega)=m(\omega)1$ is $$s(\omega)=q(\omega)(1-r(\omega))m(\omega)1. \tag{45}$$

Setting the equalization to $$q(\omega)=\frac{1}{1-r(\omega)} \tag{46}$$

leaves the canceler output equal to the canceler input for monophonic inputs.

Consider a binaural input $b(\omega)$ composed of zero-mean Gaussian random processes having identical power spectra $P_b(\omega)$ and crosscoherence $\eta$, $$E\{b(\omega)b(\omega)^T\}=P_b(\omega)\begin{bmatrix}1 & \eta\\ \eta^* & 1\end{bmatrix}, \tag{47}$$

where $E\{\cdot\}$ is the expectation operator and $\cdot^T$ is the Hermetian transpose. (Note that the binaural channel crosscoherence $\eta$ is the energy in the product of the binaural channel signals normalized by the mean of the individual channel signal energies, so that it takes on values in the range [−1,1]. The energies, and therefore $\eta$, may be evaluated as functions of frequency, or they may represent the total energy over the band.) The total power appearing at the output of a canceler $X(\omega)=q(\omega)R(\omega)$—the sum of the left and right channel output powers—in response to the Gaussian input $b(\omega)$ is $$E\{s(\omega)^T s(\omega)\}=2|q(\omega)|^2P_b(\omega)(1+|r(\omega)|^2-2R\{\eta r(\omega)\}). \tag{48}$$

Accordingly, the inventive equalization has a power given by $$|q(\omega)|^2=\frac{1}{1+|r(\omega)|^2-2\mathcal{R}\{\eta\, r(\omega)\}}, \tag{49}$$

so as to leave the total power of a random process with channel crosscoherence $\eta$ unchanged at the output. It is worth pointing out that if the input binaural signal were a deterministic signal decomposed into sum—that is, monophonic—and difference components, with $\eta$ measuring the percentage monophonic energy less the percentage difference energy, the equalization (49) leaves the total output power unchanged.

Note that if the input were monophonic, the channel crosscoherence $\eta$ would be one, and the equalization power would be that of the monophonic compatible equalization above, $$|q(\omega)|^2=\frac{1}{1+|r(\omega)|^2-2\mathcal{R}\{r(\omega)\}}. \tag{50}$$

If the input channels were statistically independent, the channel crosscoherence would be zero, and the inventive equalization power would be $$|q(\omega)|^2=\frac{1}{1+|r(\omega)|^2}. \tag{51}$$

Figure 26:
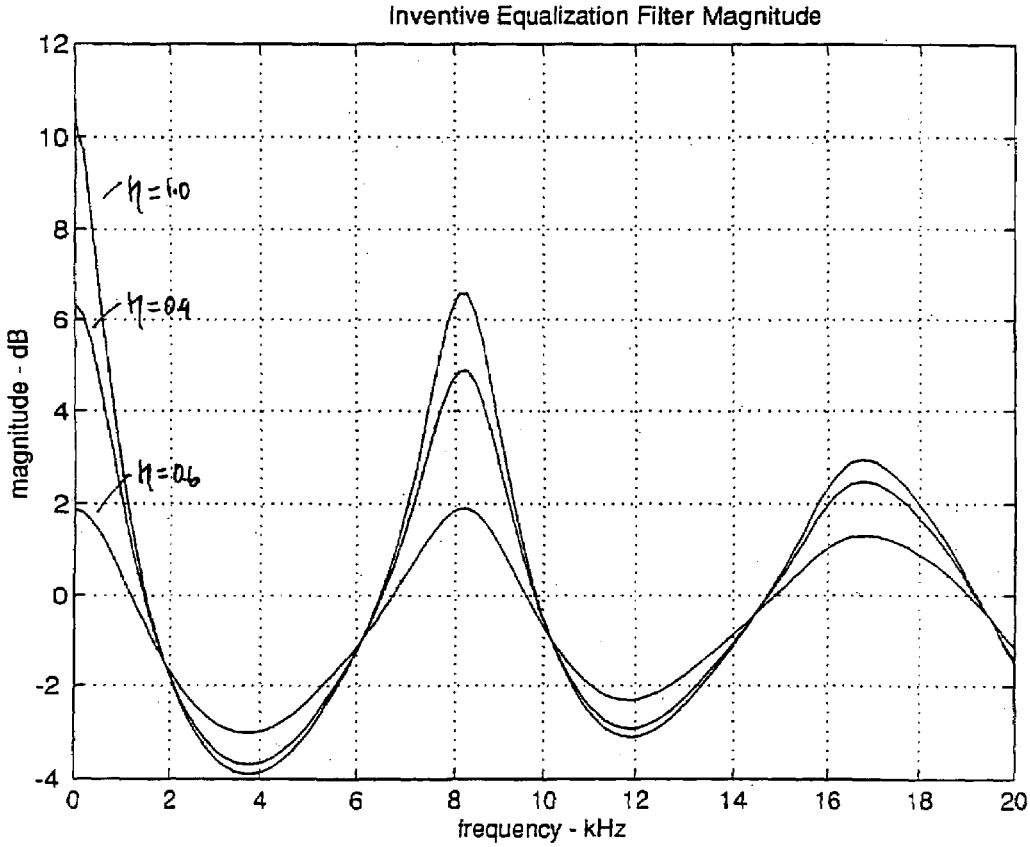
FIG. 26 shows example inventive equalizations.

The inventive equalization magnitude is plotted in FIG. 26 for a range of binaural channel crosscoherence values $\eta$.

Figure 1:
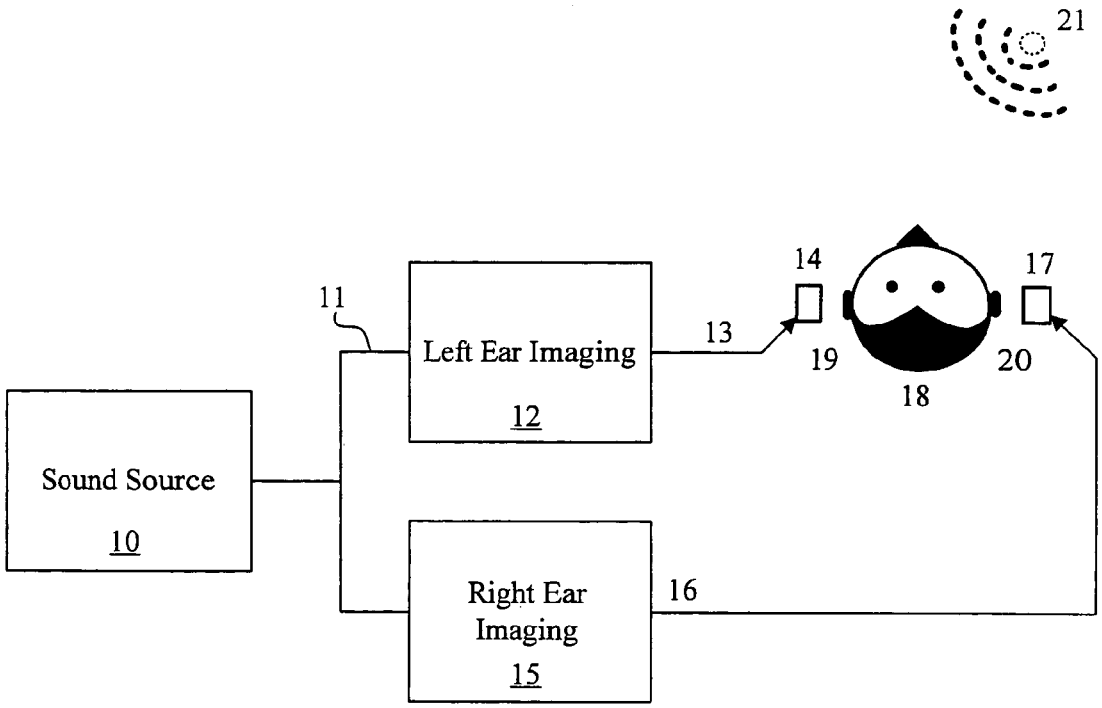
FIG. 1 shows a synthetic spatial audio display.
Figure 2:
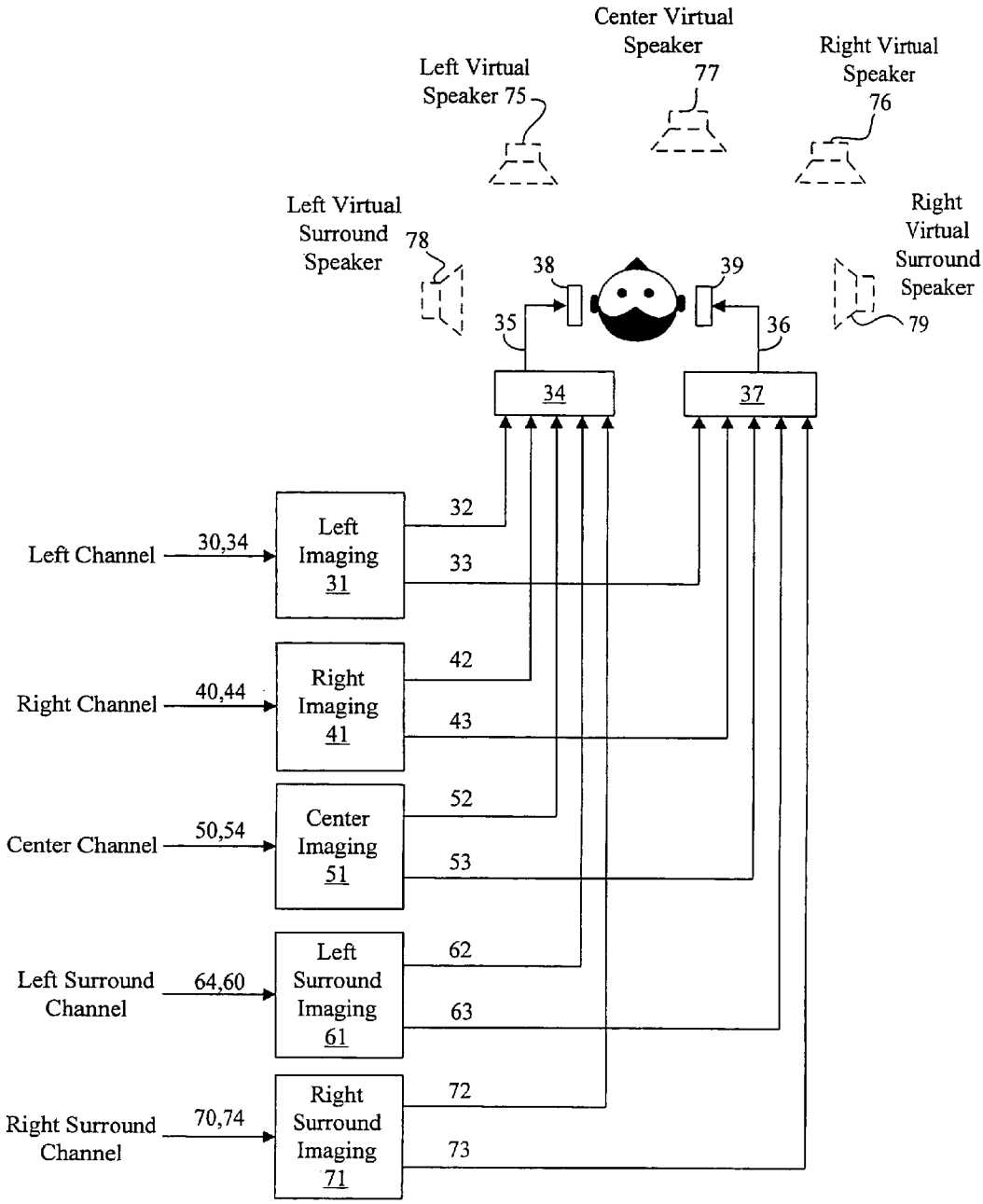
FIG. 2 shows a binaural virtual surround sound system.
Figure 3:
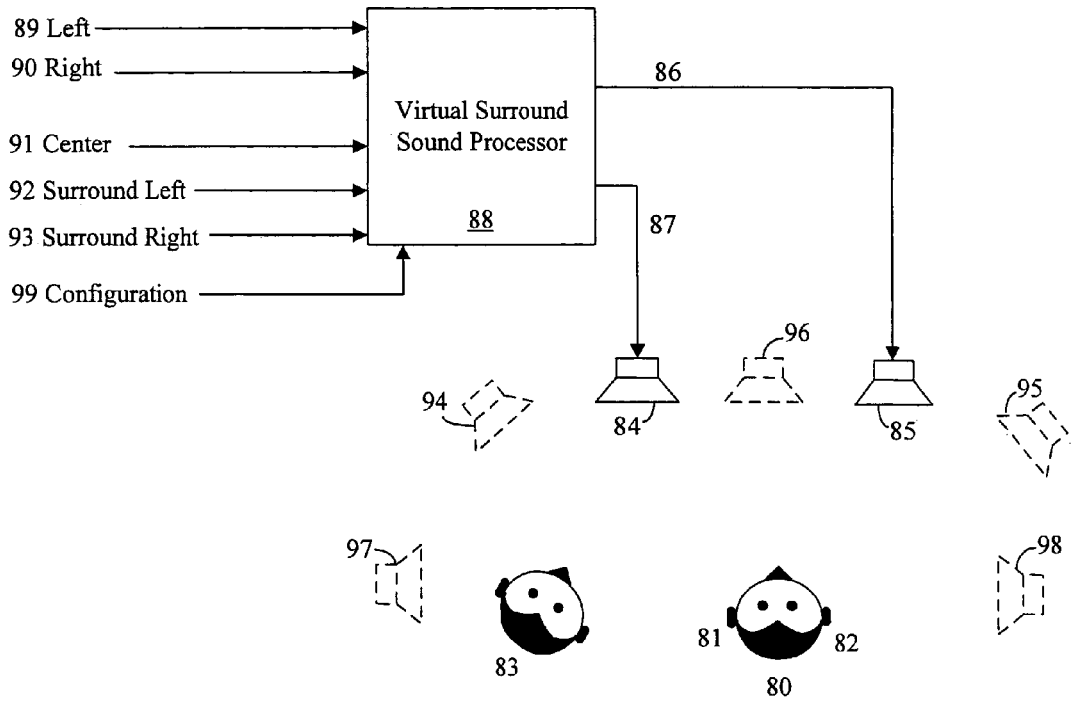
FIG. 3 shows a stereo speaker virtual surround sound system.
Figure 27:
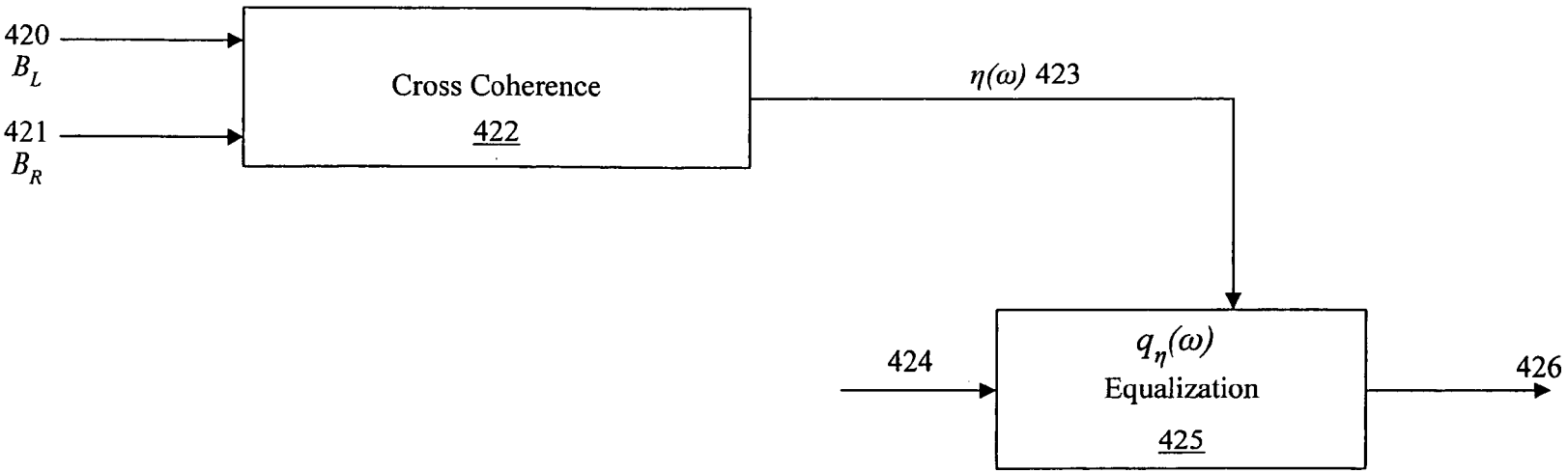
FIG. 27 shows a system for adapting crosstalk canceler equalization to signal characteristics

In many cases, the channel crosscoherence will be approximately known a priori. For instance, movie soundtracks presented in binaural virtual surround sound format as shown in FIG. 3 typically have a channel crosscoherence in the range $\eta\epsilon[0.8,0.9]$. In one embodiment, if the channel crosscoherence is not known a priori, the listener may tune the canceler equalization to his liking by adjusting the channel crosscoherence value used to determine the equalization power. In another embodiment, shown in FIG. 27, the binaural channel crosscoherence is sensed (possibly as a function of frequency) and used to adjust the canceler equalization. Alternatively, the percentage of sum and difference energies may be used to set $\eta$.

Figure 28A:
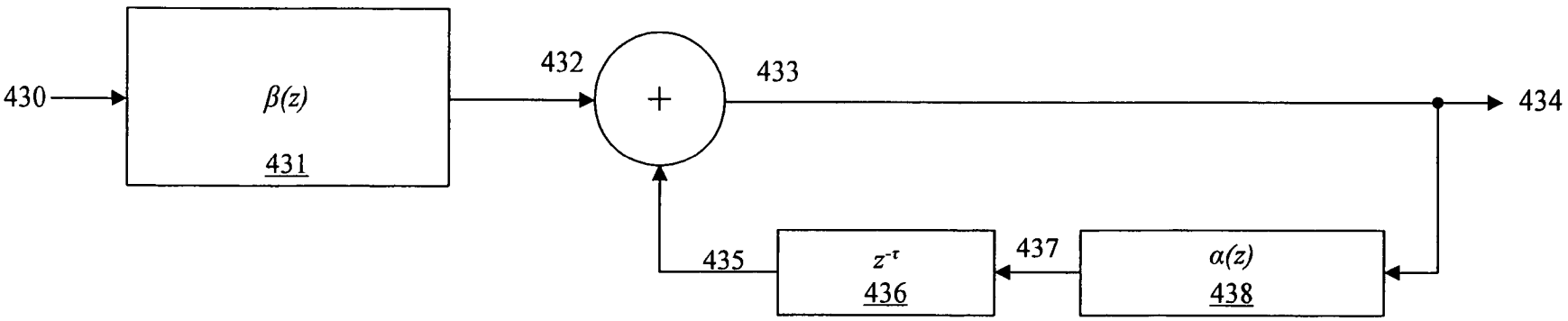
FIGS. 28*a* and 28*b* show a system and an example inventive equalization approximation.
Figure 28B:
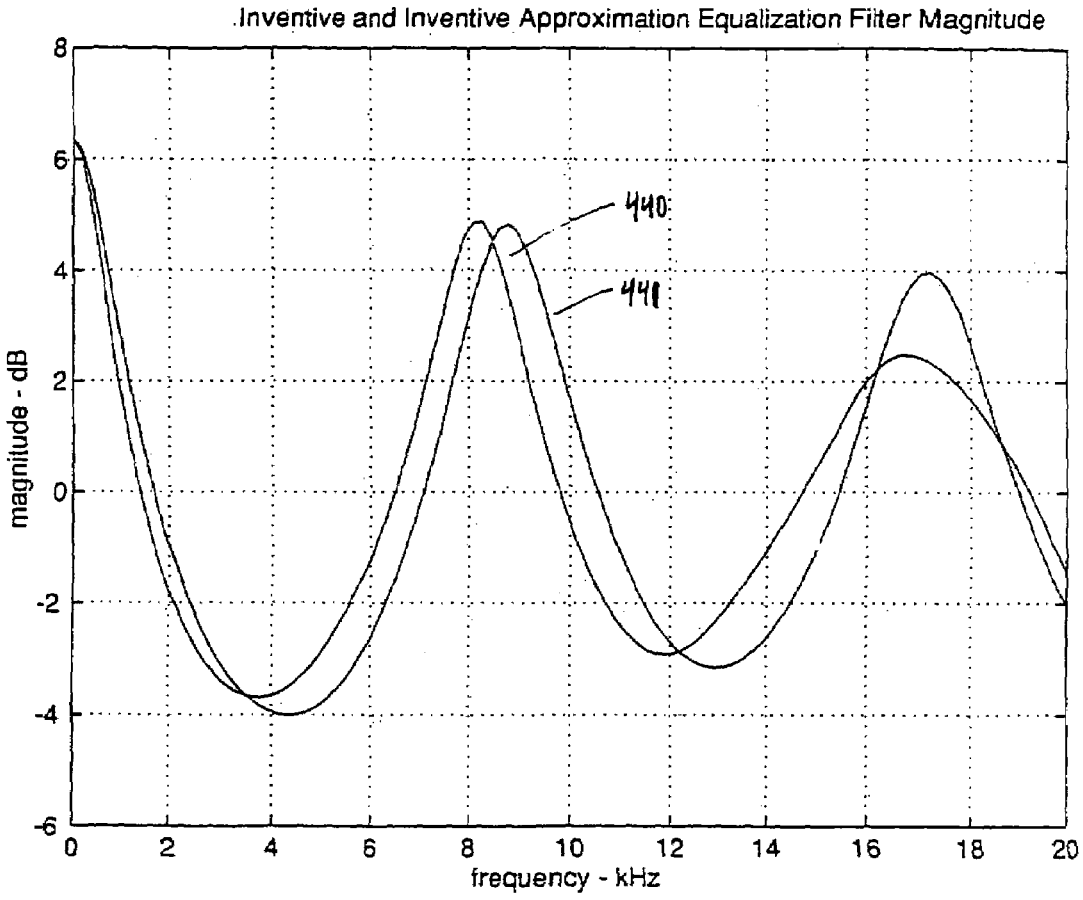

Because of the manner in which the equalization power (49) depends on the binaural channel crosscoherence $\eta$, it is difficult to adapt the equalization filter to real-time changes in $\eta$. However, the embodiment of FIG. 28 shows an equalization filter comprising two filters in a feedback delay network which has a magnitude approximating that of (49). By setting the delay $\tau$ to the near-ear-far ear arrival time difference implied by the mixing filter $r(\omega)$, and by designing the filters $\alpha(\omega)$ and $\beta(\omega)$ to have magnitudes that approximate $$|\alpha(\omega)|=\gamma-[\gamma^2-1]^{\frac{1}{2}},\ \gamma=\frac{1+|r(\omega)|^2}{2|\eta\, r(\omega)|} \tag{52}$$

$$|\beta(\omega)|=\left[\frac{1+|\alpha(\omega)|^2}{1+|r(\omega)|^2}\right]^{\frac{1}{2}}, \tag{53}$$

the resulting system 441 will closely approximate the desired equalization filter $q(\omega)$ 440, as shown in the example of FIG. 28. Note that the approximation remains valid even under rather crude approximations to the magnitude characteristics specified for $\alpha(\omega)$ and $\beta(\omega)$ above. For the approximation of FIG. 28, the filters $\alpha(\omega)$ and $\beta(\omega)$ were designed by matching the specified magnitudes only at DC, the band edge, and at 3 kHz.

REFERENCES

[1] B. Atal and M. Schroeder, "Apparent Sound Source Translator," U.S. Pat. No. 3,236,949, Feb. 22, 1966.

[2] D. Cooper and J. Bauck, "Head Diffraction Compensated Stereo System," U.S. Pat. No. 4,893,342, Jan. 9, 1990.

[3] D. Cooper and J. Bauck, "Head Diffraction Compensated Stereo System with Optimal Equalization," U.S. Pat. No. 4,910,779, Mar. 20, 1990.

[4] D. Cooper and J. Bauck, "Head Diffraction Compensated Stereo System with Optimal Equalization," U.S. Pat. No. 4,975,954, Dec. 4, 1990.

[5] D. Begault, 3-*D Sound for Virtual Reality and Multimedia*, Cambridge Mass.: Academic Press, 1994.

[6] J. Blauert, *Spatial Hearing*, Cambridge Mass.: MIT Press, 1983.

[7] E. M. Wenzel, "Localization in virtual acoustic displays," *Presence*, vol. 1, no. 1, pp. 80-107, Summer 1992.

I claim:

1. A method for crosstalk cancellation, which allows a listener a degree of freedom at movement, comprising:

accepting a binaural signal intended for the left and right ears of a listener; and filtering the binaural signal according to a matrix of transfer functions to produce output signals suitable for reproduction through at least two loudspeakers, each element of the pseudoinverse of said matrix having, in each of a plurality of frequency bands, a magnitude substantially proportional to the magnitude of the transfer function between the loudspeaker and the listener ear corresponding to that element for a listener position chosen from a plurality of listener positions corresponding to the plurality of frequency bands.

2. A method for crosstalk cancellation, which allows a listener a degree of freedom of movement, comprising:

accepting a binaural signal intended for the left and right ears of a listener; and filtering the binaural signal according to a matrix of transfer functions to produce output signals suitable for reproduction through at least two loudspeakers, the magnitude of an element of said matrix substantially being a smoothed version of the magnitude of the corresponding element of a matrix designed to cancel crosstalk, wherein said smoothing increased over frequencies at which the transfer functions between said loudspeakers and listener ear are most sensitive to listener position.

* * * * *